US008206179B2

(12) United States Patent
Ouellette et al.

(10) Patent No.: US 8,206,179 B2
(45) Date of Patent: Jun. 26, 2012

(54) MODULAR CONNECTOR SYSTEM

(75) Inventors: David A. Ouellette, Farmington, CT (US); John E. Benham, Torrington, CT (US)

(73) Assignee: Winchester Electronics Corporation, Wallingford, CT (US)

( * ) Notice: Subject to any disclaimer, the term of this patent is extended or adjusted under 35 U.S.C. 154(b) by 0 days.

(21) Appl. No.: 13/017,607

(22) Filed: Jan. 31, 2011

(65) Prior Publication Data

US 2011/0269327 A1 Nov. 3, 2011

Related U.S. Application Data

(63) Continuation of application No. 12/770,348, filed on Apr. 29, 2010, now Pat. No. 7,878,860.

(51) Int. Cl.
*H01R 33/00* (2006.01)

(52) U.S. Cl. ..... 439/638

(58) Field of Classification Search ..... 439/638, 439/640, 623, 654, 498, 362, 924.2
See application file for complete search history.

(56) References Cited

U.S. PATENT DOCUMENTS

| | | | | |
|---|---|---|---|---|
| 5,498,175 | A * | 3/1996 | Yeh et al. | 439/578 |
| 5,772,450 | A | 6/1998 | Bernardini | |
| 7,270,578 | B2 * | 9/2007 | Hunag | 439/638 |
| 7,393,249 | B2 * | 7/2008 | Wagner et al. | 439/638 |
| 7,455,548 | B2 * | 11/2008 | Clark et al. | 439/534 |
| 7,500,865 | B2 * | 3/2009 | Natter et al. | 439/362 |
| 7,699,617 | B2 | 4/2010 | Benham et al. | |
| 7,782,632 | B2 * | 8/2010 | Della Fiora et al. | 361/826 |
| 2005/0161254 | A1 | 7/2005 | Clink | |
| 2009/0053937 | A1 * | 2/2009 | Tsou et al. | 439/638 |
| 2009/0093138 | A1 | 4/2009 | Benham et al. | |
| 2009/0277665 | A1 * | 11/2009 | Kumamoto et al. | 174/113 R |
| 2009/0286425 | A1 * | 11/2009 | Wadoux | 439/638 |

OTHER PUBLICATIONS

International Search Report and Written Opinion issued on Jun. 22, 2010 in International application No. PCT/US2010/033008, 6 pages.

* cited by examiner

*Primary Examiner* — Jean F Duverne
(74) *Attorney, Agent, or Firm* — Rothwell, Figg, Ernst & Manbeck, P.C.

(57) ABSTRACT

The present invention provides a modular connector system for, in some embodiments, interconnecting circuit boards. In some embodiments, the modular connector system includes a header assembly for blind mating with an adapter assembly.

13 Claims, 45 Drawing Sheets

MODULAR CONNECTOR SYSTEM

RELATED APPLICATION

This application is a continuation of U.S. patent application Ser. No. 12/770,348, filed Apr. 29, 2010, which issued as U.S. Pat. No. 7,878,860, the entire contents of the aforementioned patent application and patent are incorporated by reference herein.

BACKGROUND

The present invention generally relates to apparatuses for interconnecting circuit boards or other electrical components.

SUMMARY

Embodiments of the present invention provide a modular approach for blind mate interconnects. In one aspect, the invention provides a connector assembly that includes an adapter assembly and a header assembly configured to connect directly to a circuit board and configured to blind mate with the adapter assembly. In some embodiments, blind mate features incorporated into the assemblies provide 0.62 mm axial and +/−0.75 mm radial mis-alignment tolerances. Additionally, the modular approach facilitates connecting the adapter assembly of one connector assembly to the adapter assembly of another connector assembly.

In some embodiments, the adapter assembly comprises: an adapter housing; a first insulator in the form of a generally rectangular solid block having a plurality of through holes; a first set of contacts, each contact in said first set being disposed in one of said though holes such that and an end portion of the contact extends beyond a surface of the first insulator, which end portion is configured to mate with a corresponding contact of the header assembly; a second insulator in the form of a generally rectangular solid block having a plurality of through holes; and a second set of contacts, each contact in said second set being disposed in one of said though holes of said second insulator such that and an end portion of the contact extends beyond a surface of the second insulator, which end portion is configured to mate with a corresponding contact of the header assembly.

In some embodiments, the header assembly comprises: a header housing; a third insulator in the form of a generally rectangular solid block having a plurality of through holes; a third set of contacts, each contact in said third set (a) having a first end portion and a second end portion, said first end portion being configured to mate with a corresponding element of the circuit board and the second end portion being directly connected to a contact from the first set of contacts and (b) being disposed in one of said though holes such that the first end portion of the contact extends beyond a surface of the third insulator; a fourth insulator in the form of a generally rectangular solid block having a plurality of through holes; and a fourth set of contacts, each contact in said fourth set (a) having a first end portion and a second end portion, said first end portion being configured to mate with a corresponding element of the circuit board and the second end portion being directly connected to a contact from the second set of contacts and (b) being disposed in one of said though holes such that the first end portion of the contact extends beyond a surface of the fourth insulator.

In some embodiments, a float plate is attached to the adapter assembly. The float plate may be configured to floatably connect the adapter assembly to a frame.

Advantageously, in some embodiments, the adapter housing comprises means for facilitating alignment of the header assembly with the adapter assembly, the header housing comprises means for facilitating alignment of the header assembly with the adapter assembly, and the third and fourth insulator each comprises means for facilitating alignment of the header assembly with the adapter assembly.

The above and other aspects and embodiments are described below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements.

DETAILED DESCRIPTION

Figure 1:
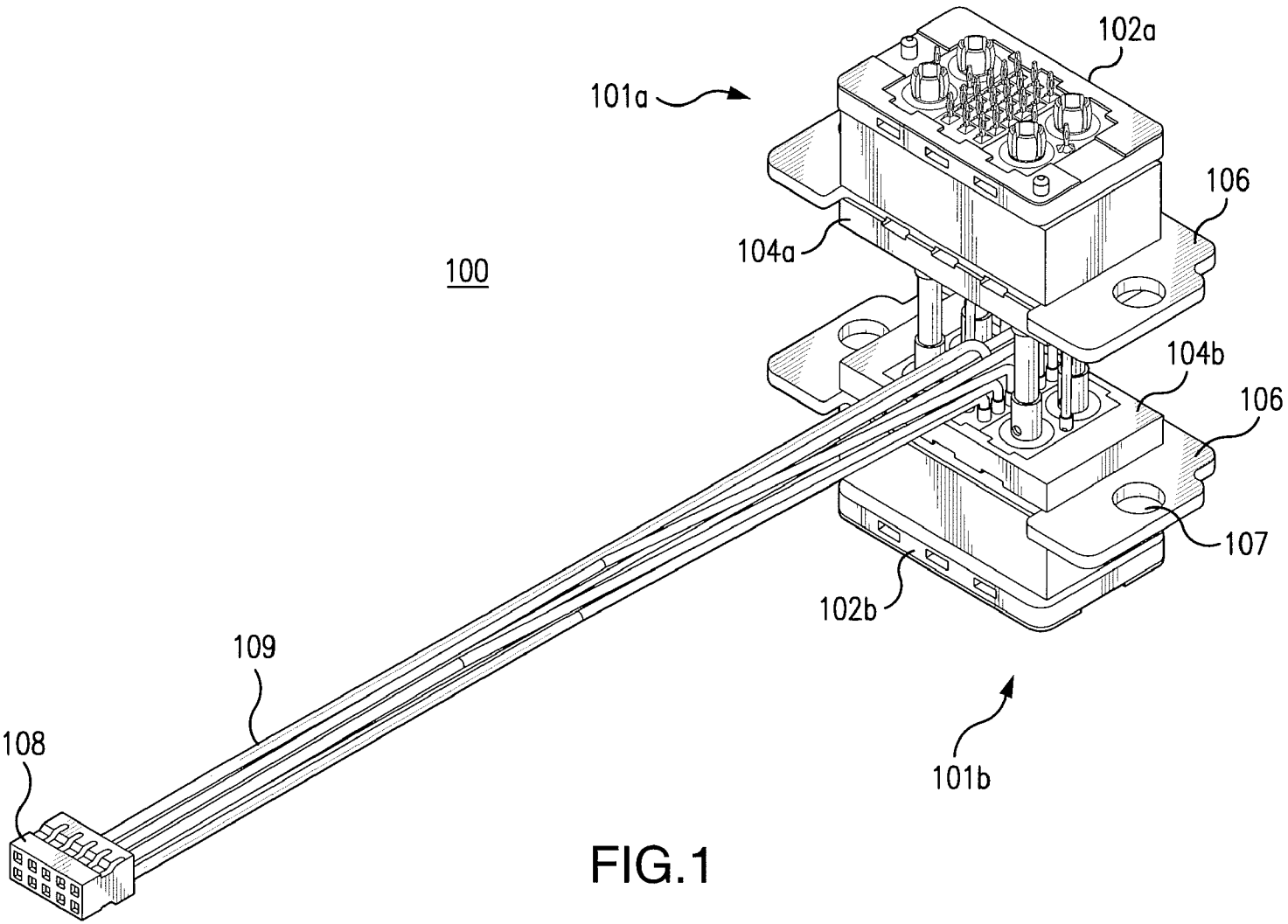
FIGS. 1-26 illustrate a connector system according to embodiments of the invention.

Referring now to FIG. 1, FIG. 1 illustrates a connector system 100 according to an embodiment of the invention. As shown, connector system 100 may include a first connector assembly 101*a* electrically connected to a second connector assembly 101*b*. Connector assembly 101*a* may be substantially identical to connector assembly 101*b*. As also shown, system 100 may include a plug 108 electrically connected to connector assembly 101*b*. Each connector assembly 101 (i.e., connector assemblies 101*a,b*) may include a header assembly 102 and an adapter assembly 104 (i.e., connector assembly 101*a* may include header assembly 102*a* and adapter assembly 104*a* and connector assembly 101*b* may include header assembly 102*b* and adapter assembly 104*b*). Each assembly 101 may also include a float plate 106 for connecting the adapter assembly 104 to a frame (e.g., a chassis) or other device. Float plate 106 may be configured to snap onto adapter assembly 104.

Figure 2:
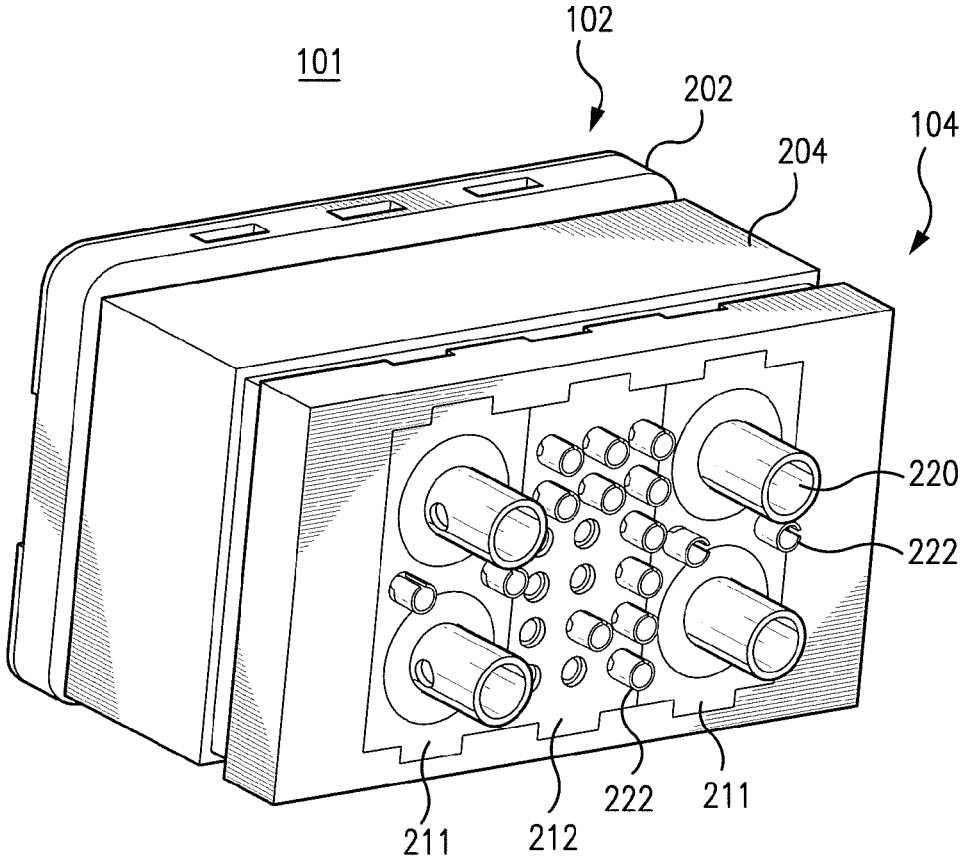

Referring now to FIG. 2, FIG. 2 is a top view of an exemplary connector assembly 101. As shown, header assembly 102 of the connector assembly 101 may include a header housing 202, and adapter assembly 104 may also include an adapter housing 204 for housing various insulators (i.e., housings that house contacts and electrically insulate the contacts from one another). In the example shown, adapter housing 204 is housing two power/RF insulators 211 and a signal insulator 212, the power/RF insulators 211 are housing two power contacts 220 and two signal contacts 222, and the signal insulator 212 is housing a number of signal contacts 222.

Figure 3:
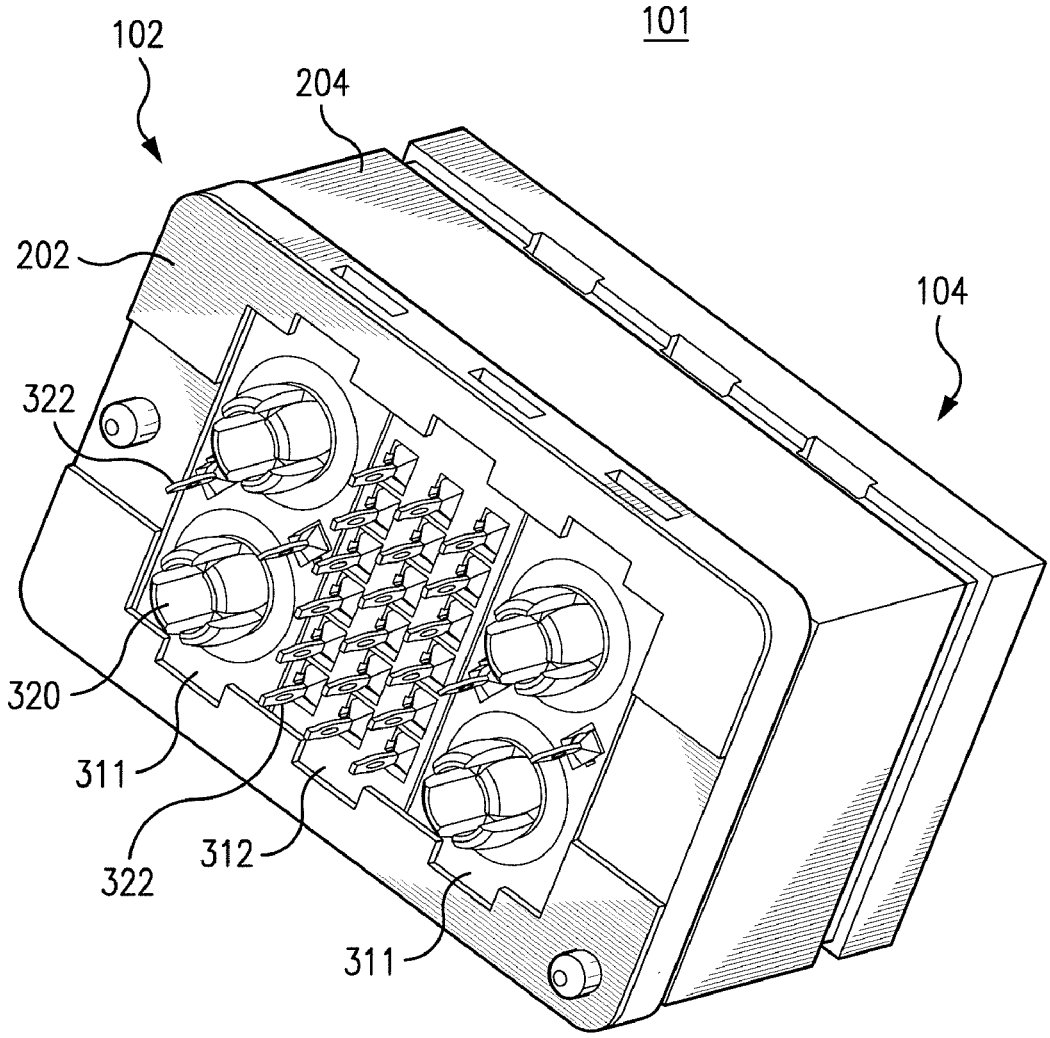
Figure 4:
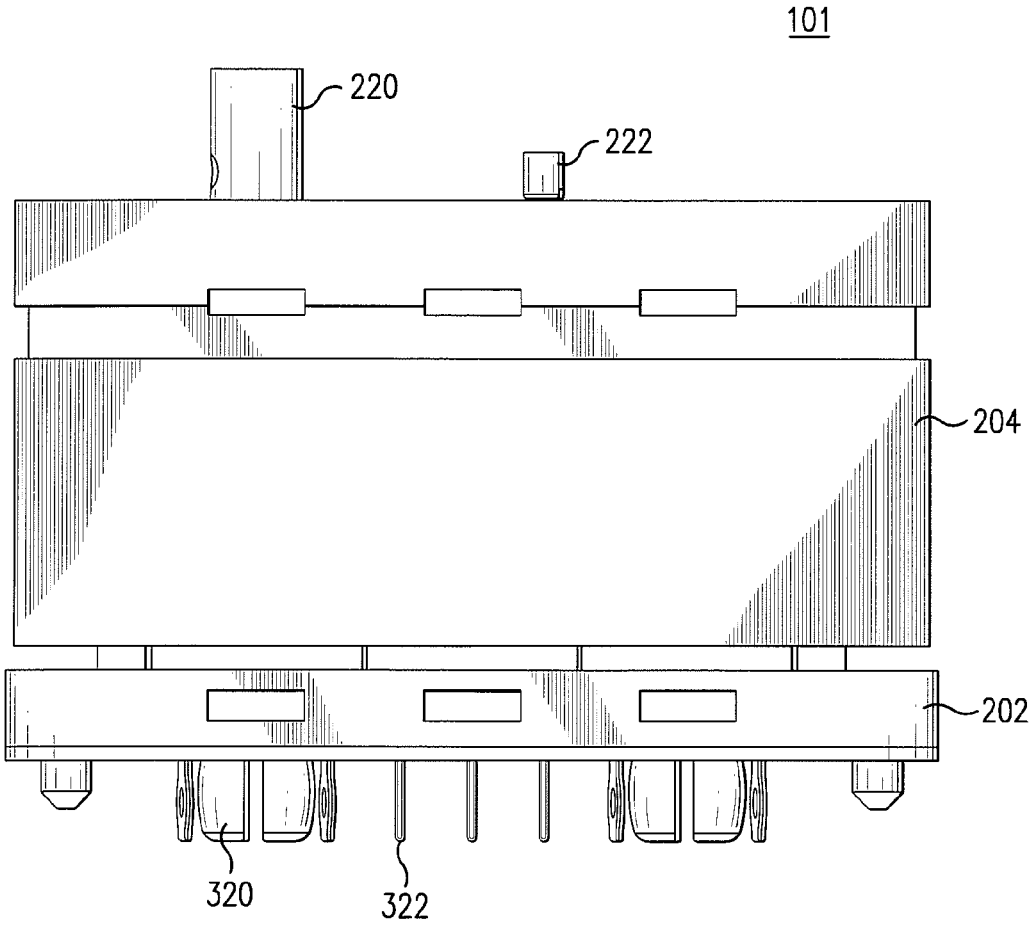

Referring now to FIG. 3, FIG. 3 is a bottom view of the exemplary connector assembly 101. In the example shown, housing 202 is housing two power/RF insulators 311 and a signal insulator 312, the power/RF insulators 311 are housing two power contacts 320 and two signal contacts 322, and the signal insulator 312 is housing a number of signal contacts 322. FIG. 4 is a side view of connector assembly 101.

Figure 5:
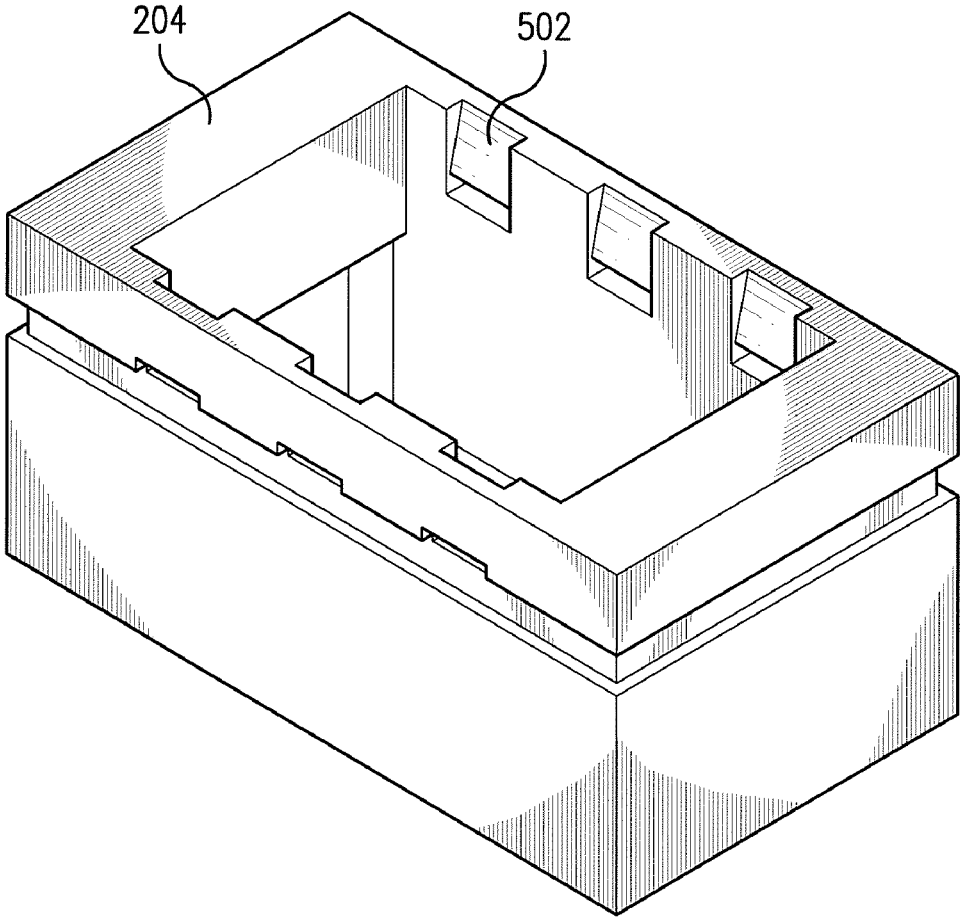
Figure 6:
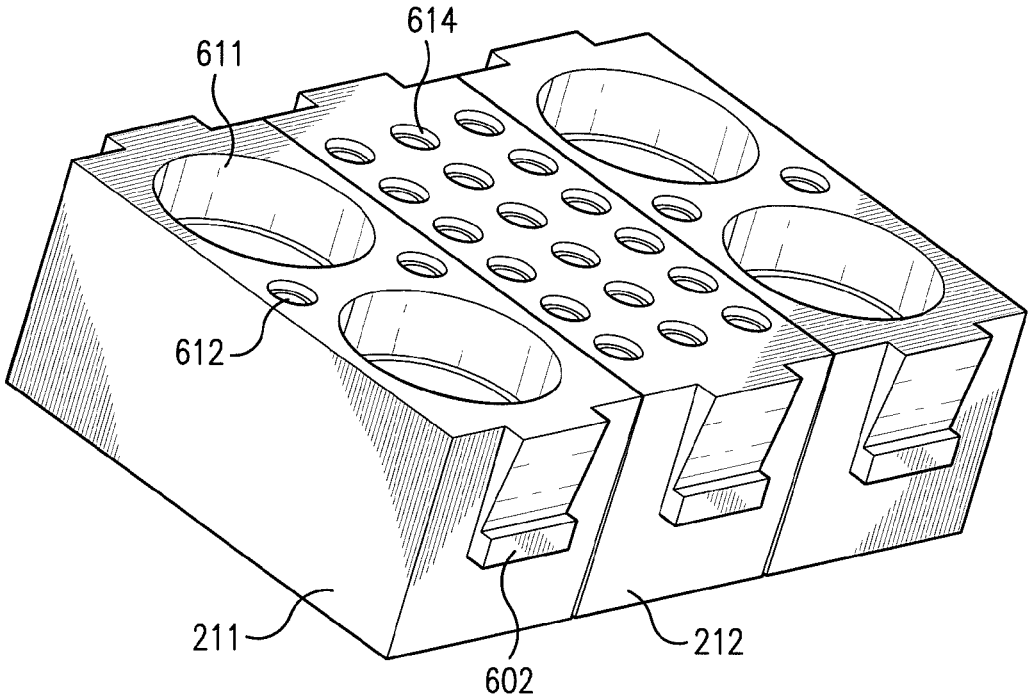

Referring now to FIG. 5, FIG. 5 is a view of an exemplary adapter housing 204. In the embodiment shown, housing 204 is a generally rectangular housing open at opposite side thereof having two end walls and two side walls, and the side walls include grooves 502 for receiving a locking tab 602 (see FIG. 6) formed on a side wall of an insulator. The depth of the groove 502 decreases as the groove 502 proceeds inwardly, thereby forming a ramp structure. This facilitates the locking of an insulator in the adapter housing. FIG. 6 illustrates three insulators and the locking tab 602. The locking tab 602 is configured to engage groove 502, as illustrated in FIGS. 7 and 8.

Figure 7:
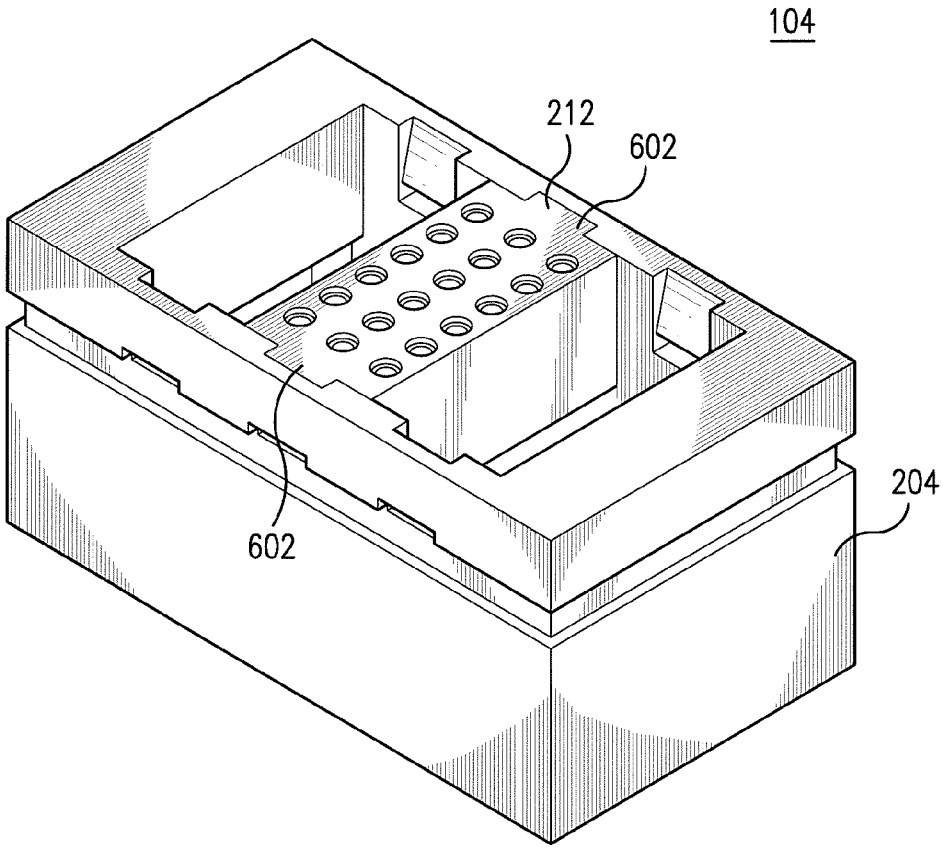
Figure 8:
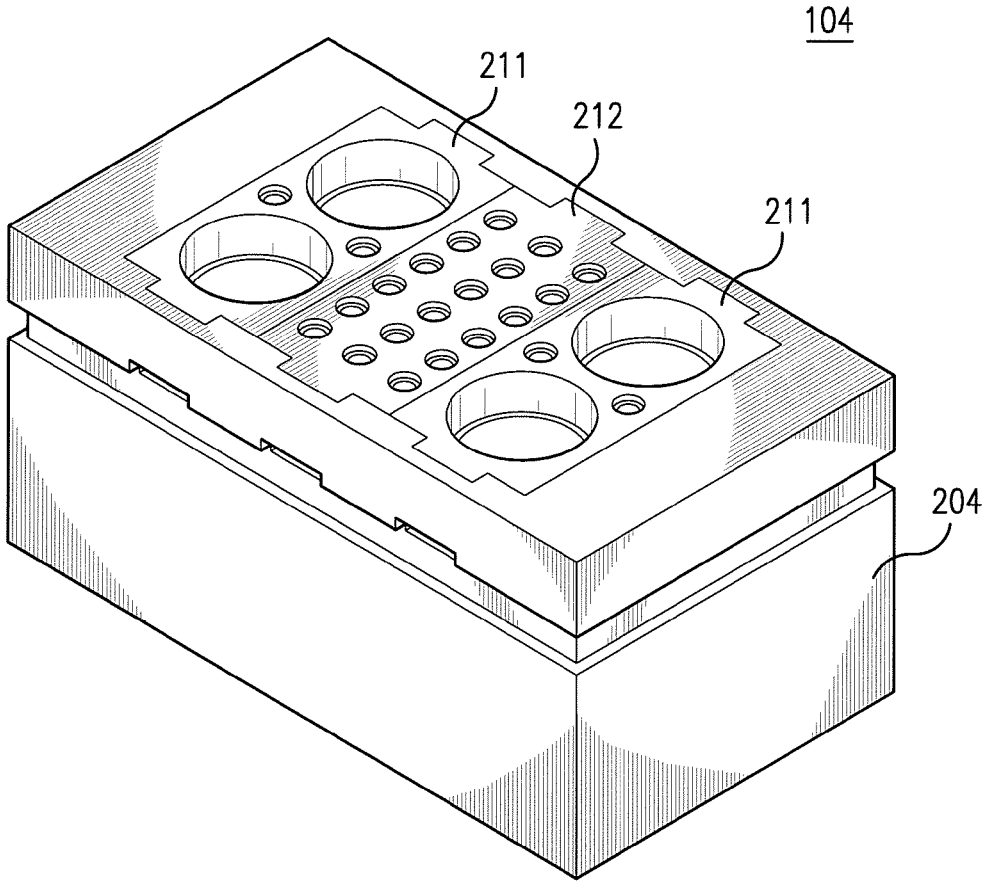

As shown in FIG. 6-8, insulators 211 and 212 are generally in the form of rectangular, solid blocks that include through holes for receiving a contact. For example, power/RF insulator 211 includes, in the embodiment shown, two through holes 611 each for receiving a power contact or RF contact and two through holes 612 each for receiving a signal contact. Likewise, signal insulator 212 includes, in the embodiment shown, eighteen through holes 614 for receiving eighteen signal contacts.

Figure 9:
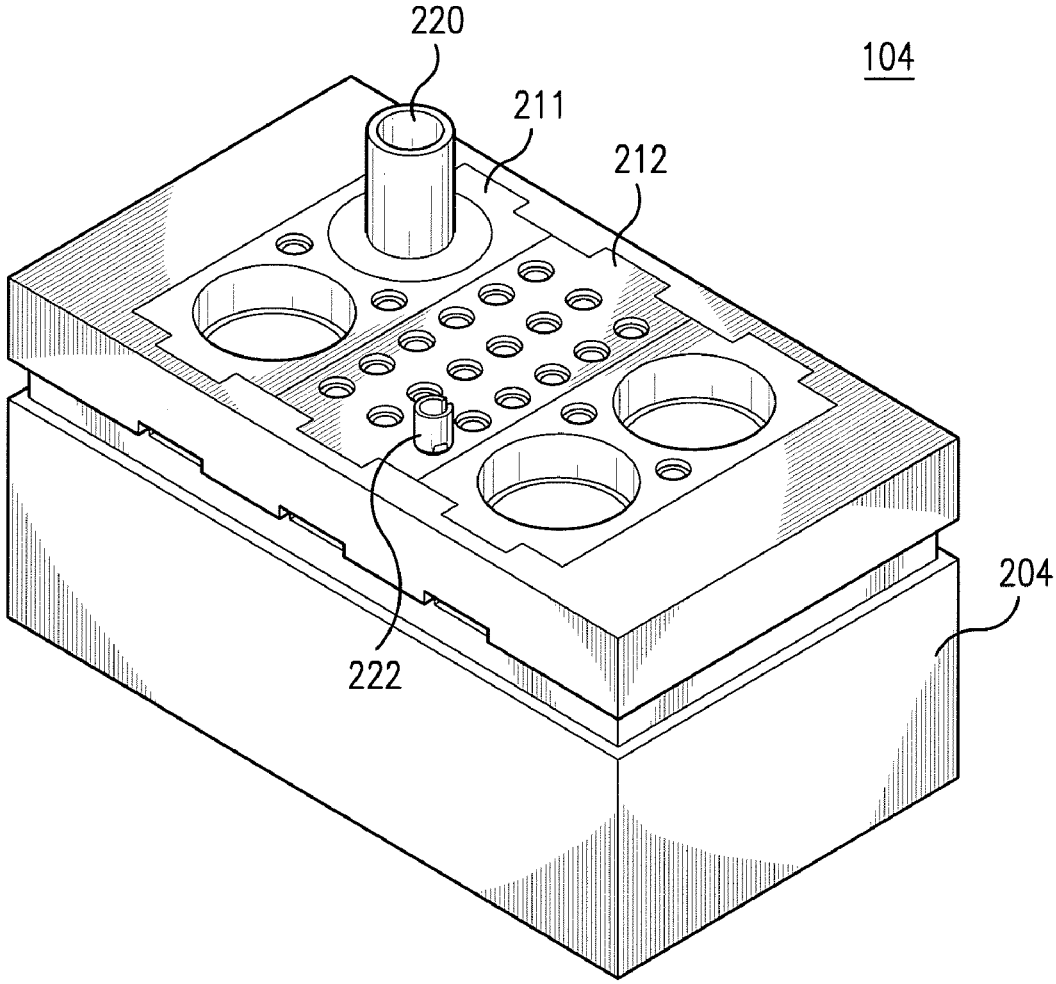
Figure 10:
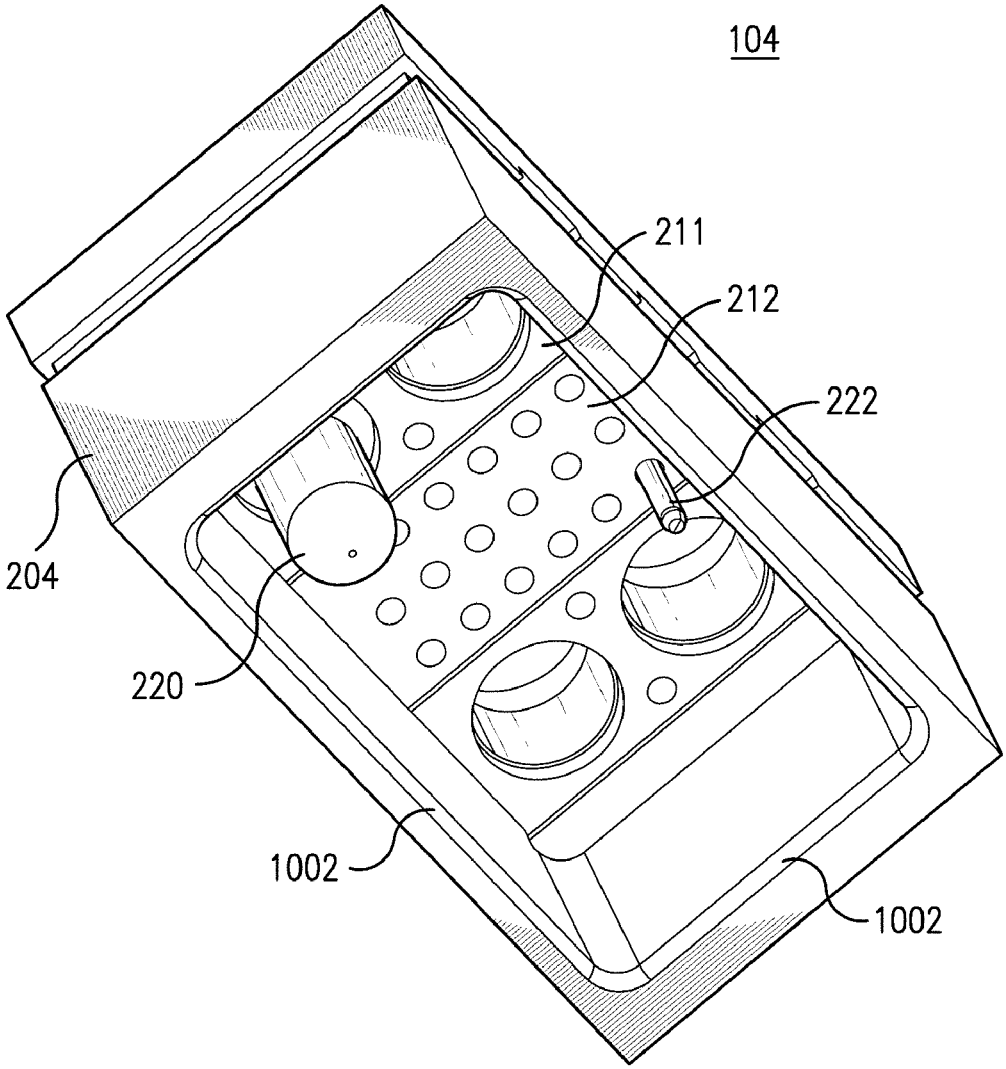

FIG. 9 is a top view of adapter assembly 104 and shows an exemplary signal contact 222 inserted into a through hole 614 of signal insulator 212. FIG. 9 also shows an exemplary power contact 220 inserted into a through hole 611 of power insulator 212. FIG. 10 is a bottom view of adapter assembly 104 and shows that an end portion of power contact 220 and an end portion of signal contact 222 passes entirely through the through holes 611 and 614, respectively. That is the end portions of contacts 220 and 222 extend beyond the bottom face of insulators 211 and 212, respectively. Insulators 211 and 212 and contacts 220 and 222 configured like this so that the end portions of the contacts can mate with corresponding contacts of the header assembly 102.

While in FIG. 9 adapter assembly 104 is shown has having two power insulators 211 and a single signal insulator 212 arranged between the power insulators, the invention is not so limited. In fact, an advantage of adapter assembly 104 is that it is extremely adaptable. That is, the type of insulators that may be housed in adapter housing 204 and the arrangement of said insulators in the housing is entirely up to the end user. Some users may desire three power insulators and no signal insulators, while others may prefer the opposite or some other combination and arrangements of insulators.

Figure 11:
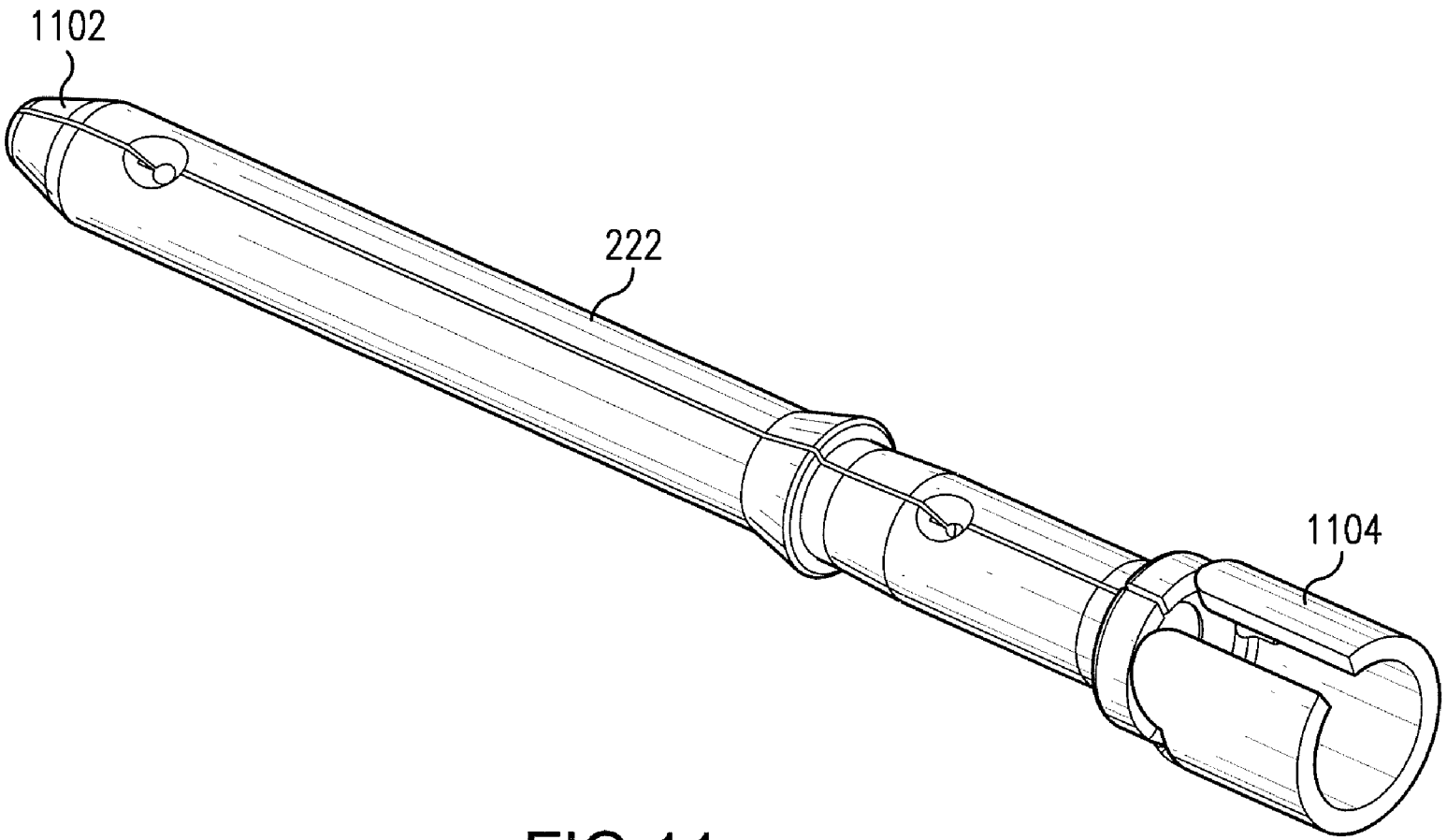
Figure 12:
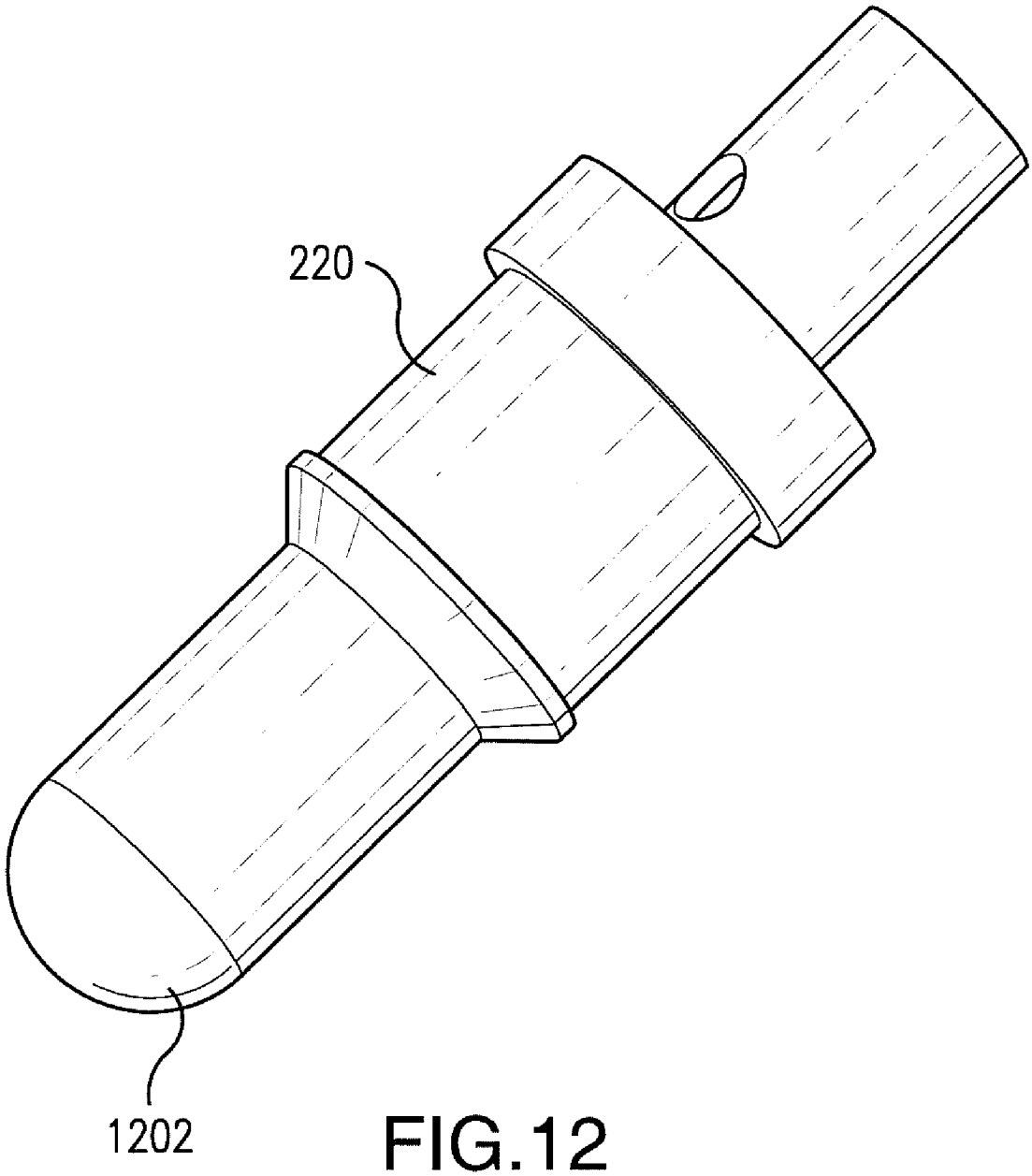

Referring now to FIG. 11, FIG. 11 illustrates an exemplary signal contact 222. The exemplary signal contact 222 is elongate, has a conical tip 1102 (a.k.a., lead in 1102), and a open, crimpable end portion 1104 for receiving a corresponding electrical element (e.g., the end of a wire). In the example shown, end portion 1104 is in a crimped state and, therefore, has a generally C shaped cross section. In an uncrimped state, end portion 1104 would have a more U shaped cross section. FIG. 12 illustrates an exemplary power contact 220, which, in the embodiment shown, includes a conical shaped lead-in 1202, which functions to facilitate alignment between assemblies 102 and 104.

Figure 13:
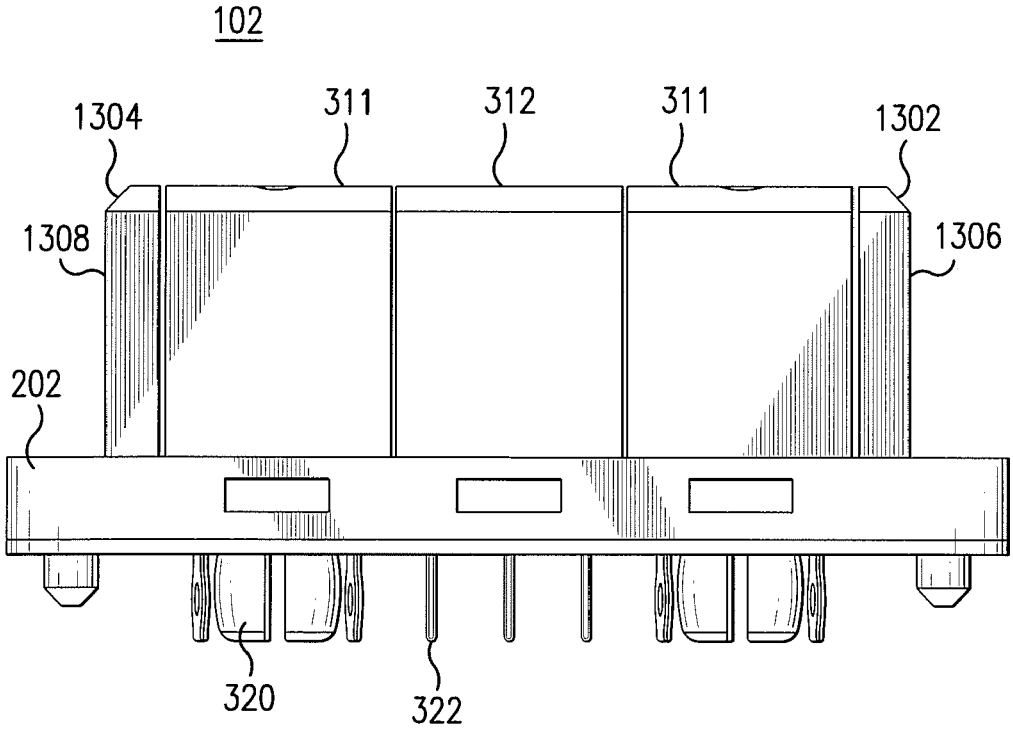

Referring now to FIG. 13, FIG. 13 illustrates an exemplary header assembly 102. Like adapter assembly 104, header assembly includes a header housing 202 for housing power/RF insulators 311 and/or signal insulators 312. In the example, shown, because adapter assembly 104 includes a signal insulator 212 sandwiched between two power insulators 211, header assembly 102 also includes a signal insulator 312 sandwiched between two power insulators 311.

Figure 14:
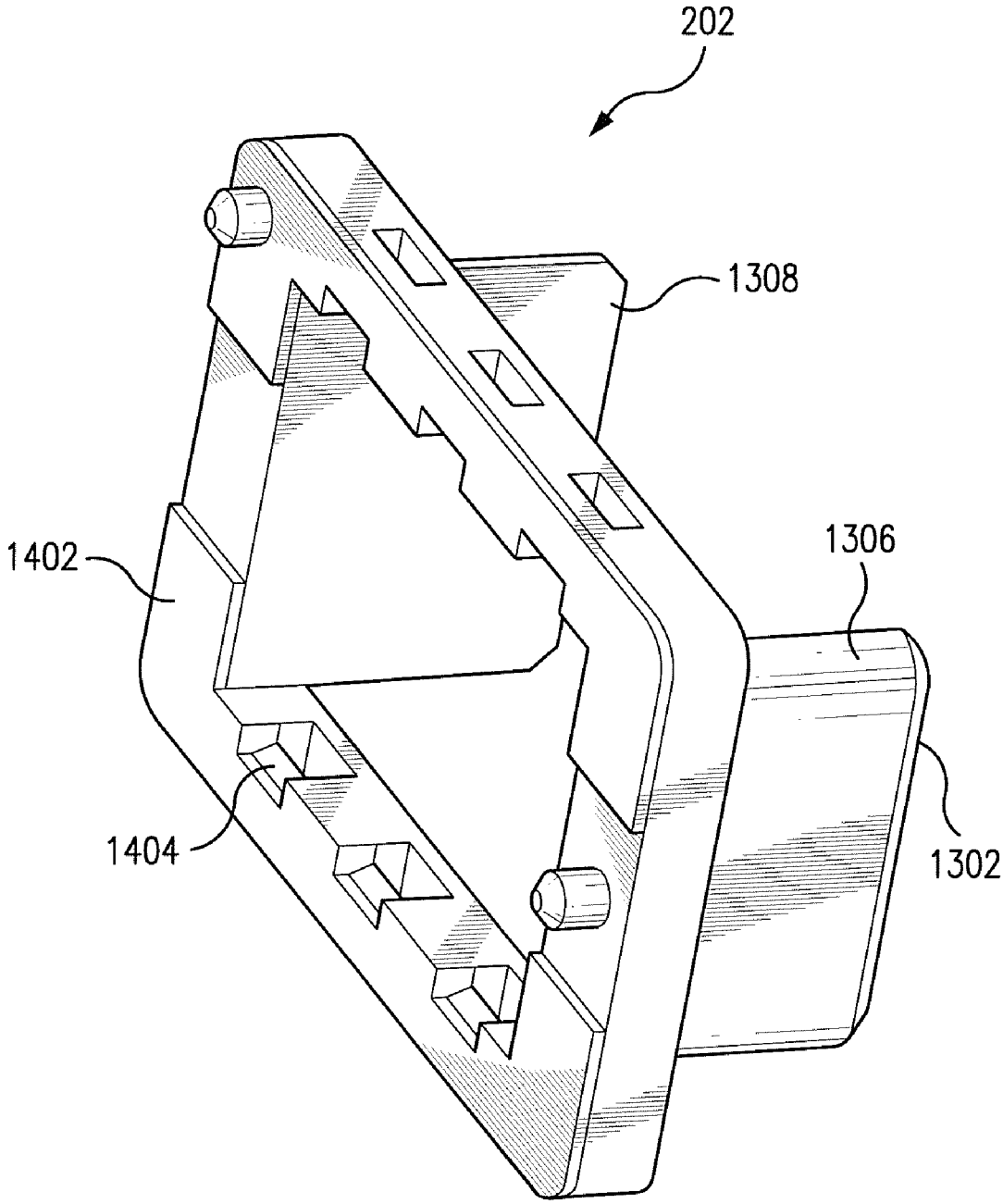
Figure 15:
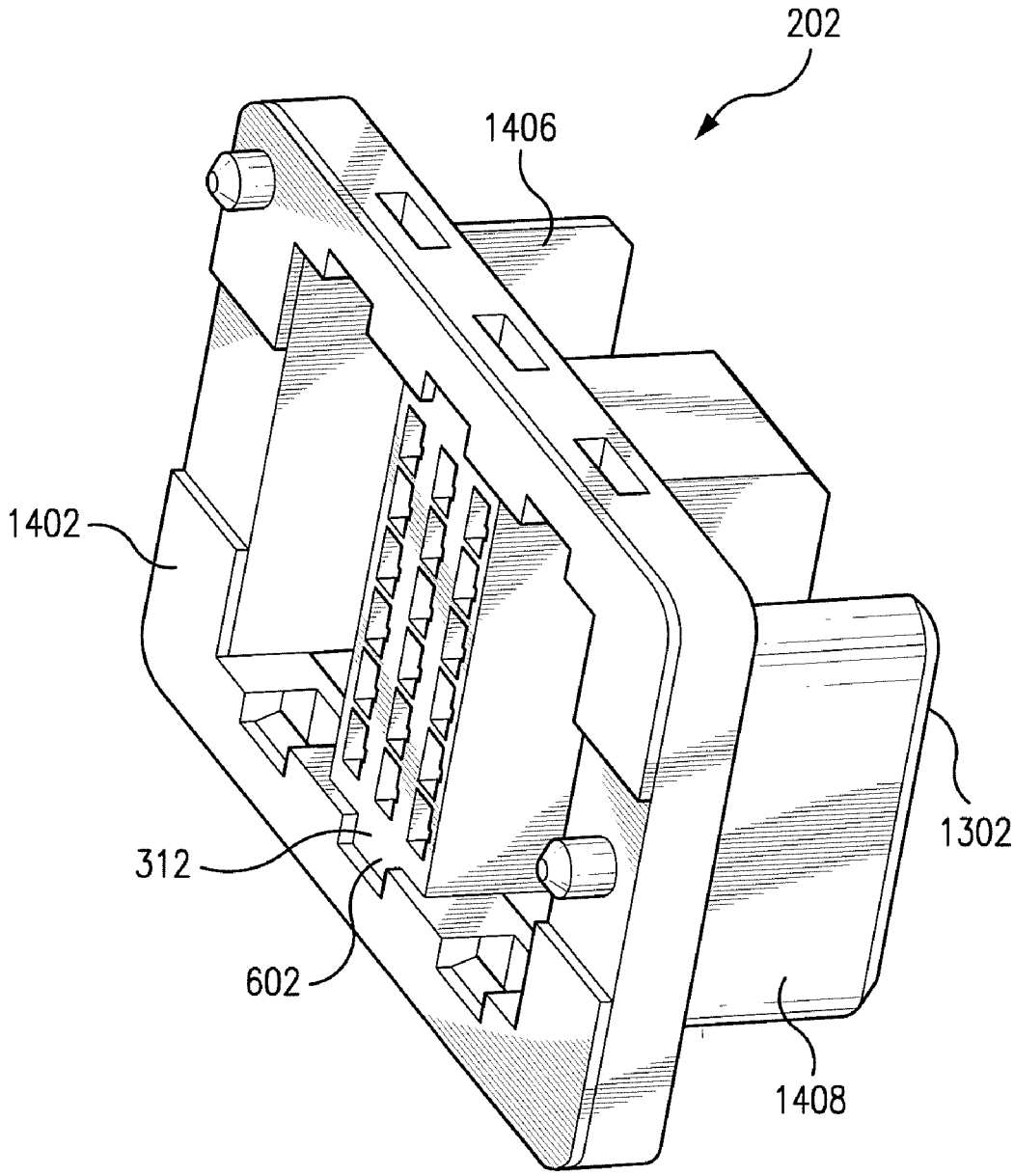

FIG. 14 further illustrates header housing 202. Like adapter housing 204, header housing 202 includes a generally rectangular frame 1402 having two parallel end walls and two parallel side walls, and the side walls include grooves 1404 for receiving a locking tab (see e.g., element 602 in FIG. 6) formed on a side wall of an insulator. The depth of the groove 1404 decreases as the groove 502 proceeds inwardly, thereby forming a ramp structure. This facilitates the locking of an insulator in the header housing 202. As also shown, housing 202 includes two parallel side walls 1306, 1308 that face each other and extend outwardly from the end walls of housing 1402. FIG. 15 shows a signal insulator 312 that has been inserted into housing 202. Groove 1404 and lock tab 602 engage to releasably retain insulator 312 in housing 202.

Figure 16:
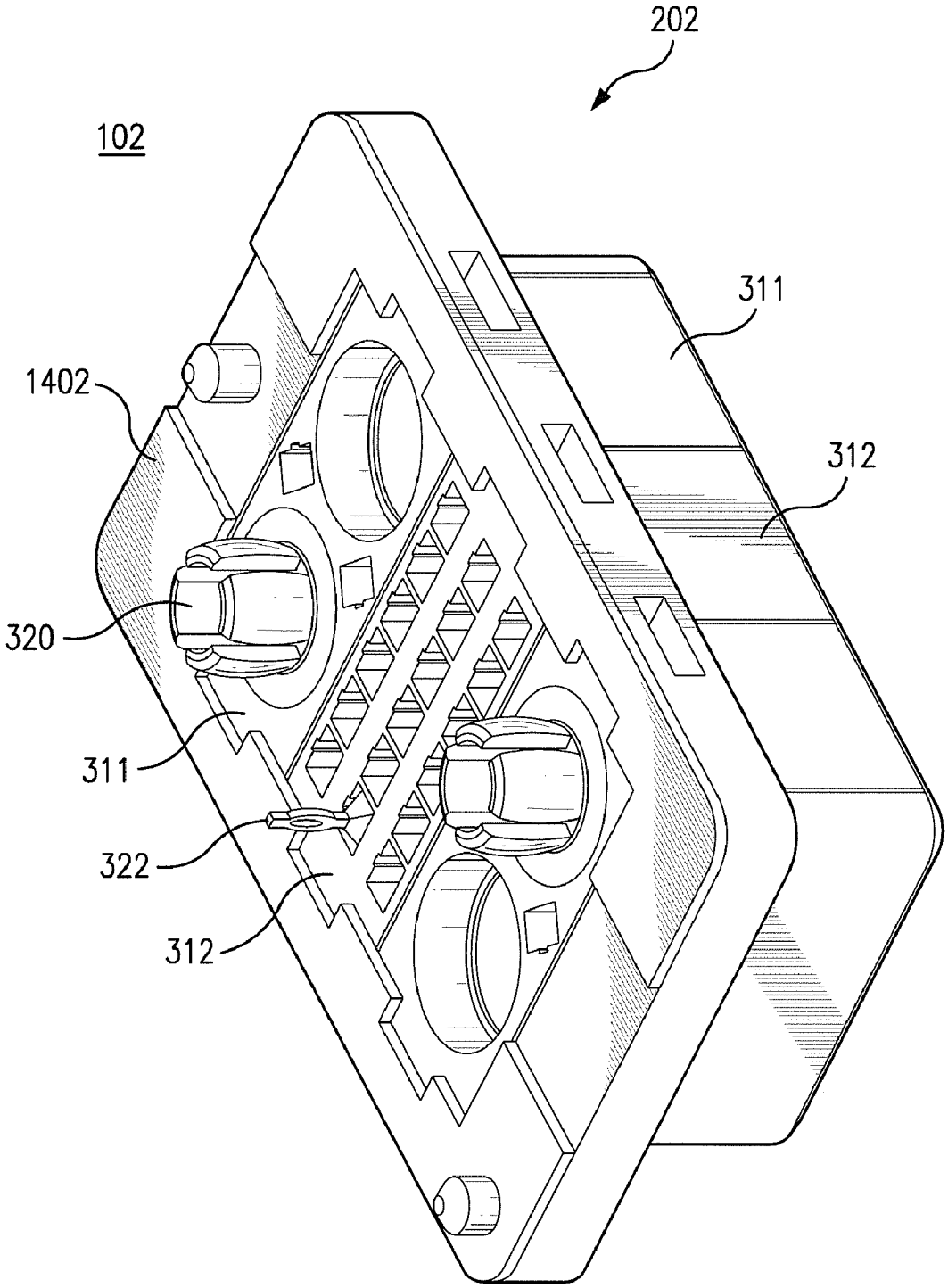
Figure 17:
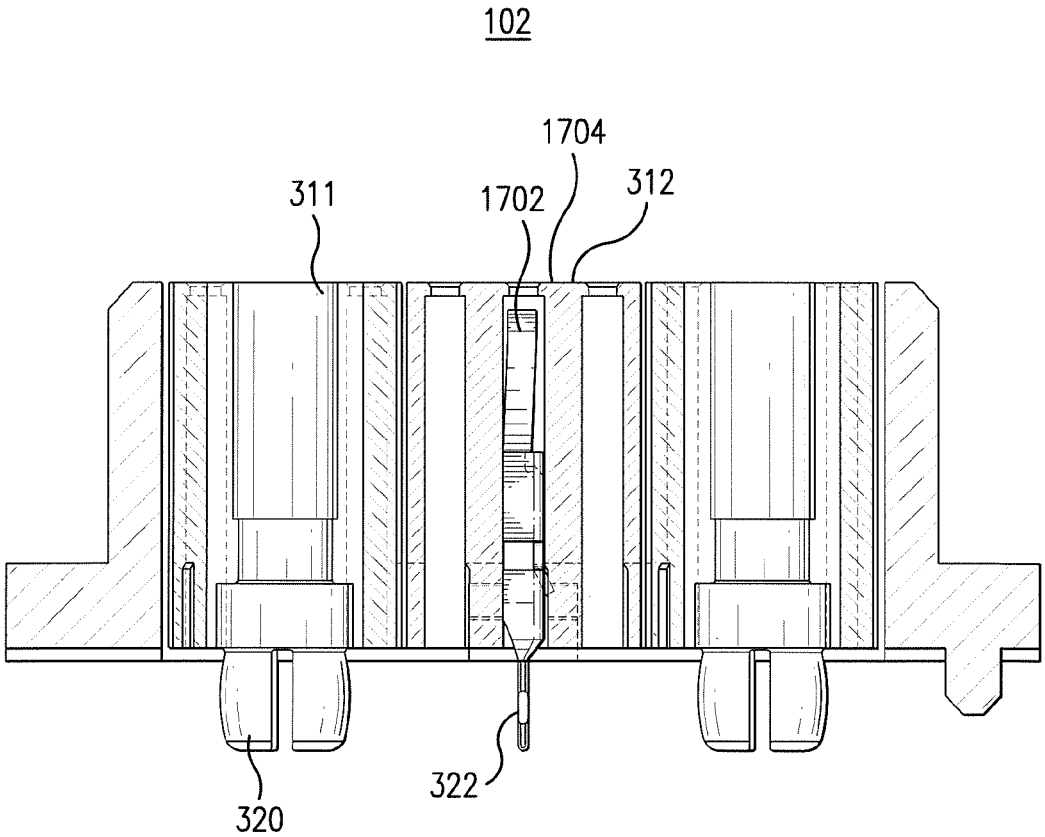
Figure 18:
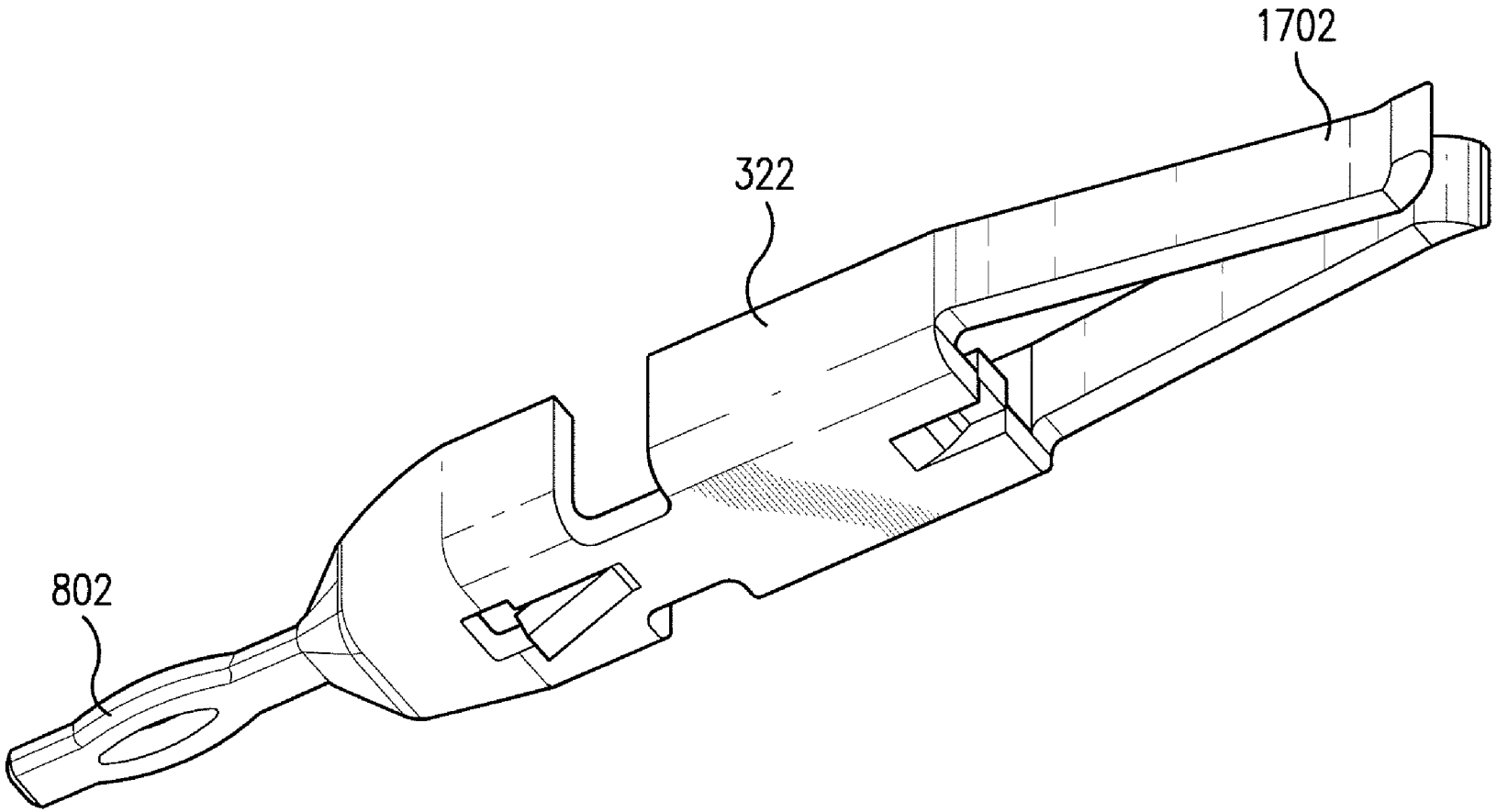
Figure 19:
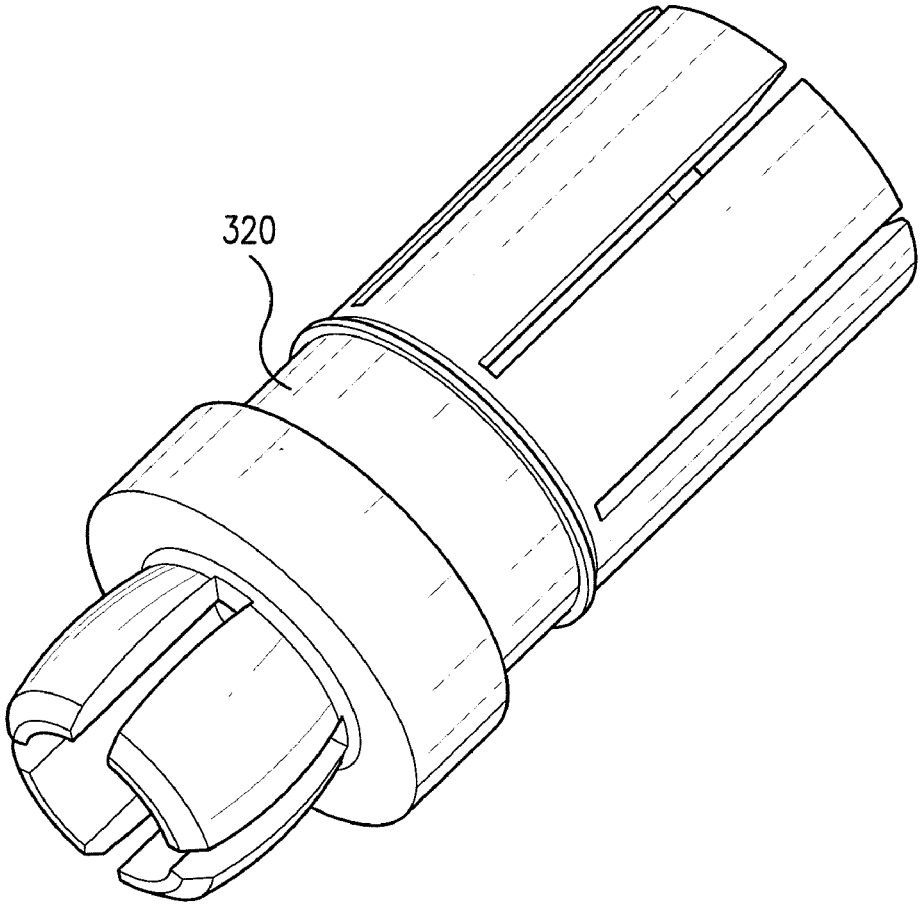

FIG. 16 shows an exemplary signal contact 322 inserted into a through hole of signal insulator 312. FIG. 16 also shows an exemplary power contact 320 inserted into a through hole of power insulator 312. FIG. 17 is a cross-sectional view of assembly 102 according to some embodiments. In the embodiment shown, the end portion 1702 of contact is disposed within the though hole. That is, in the embodiment shown, end portion 1702 does not extend beyond the upper face 1704 of signal insulator 312. FIG. 18 further illustrates contact 312 according to some embodiments. In the embodiment shown, contact 322 is elongate, has a male compliant end 1802 for solderless mating with a corresponding through hole in a circuit board, and has a female end 1702 for receiving conical tip of signal contact 222. This is further illustrated in FIG. 20. FIG. 19 shows compliant (solderless) power contact 320 according to some embodiments.

Figure 20:
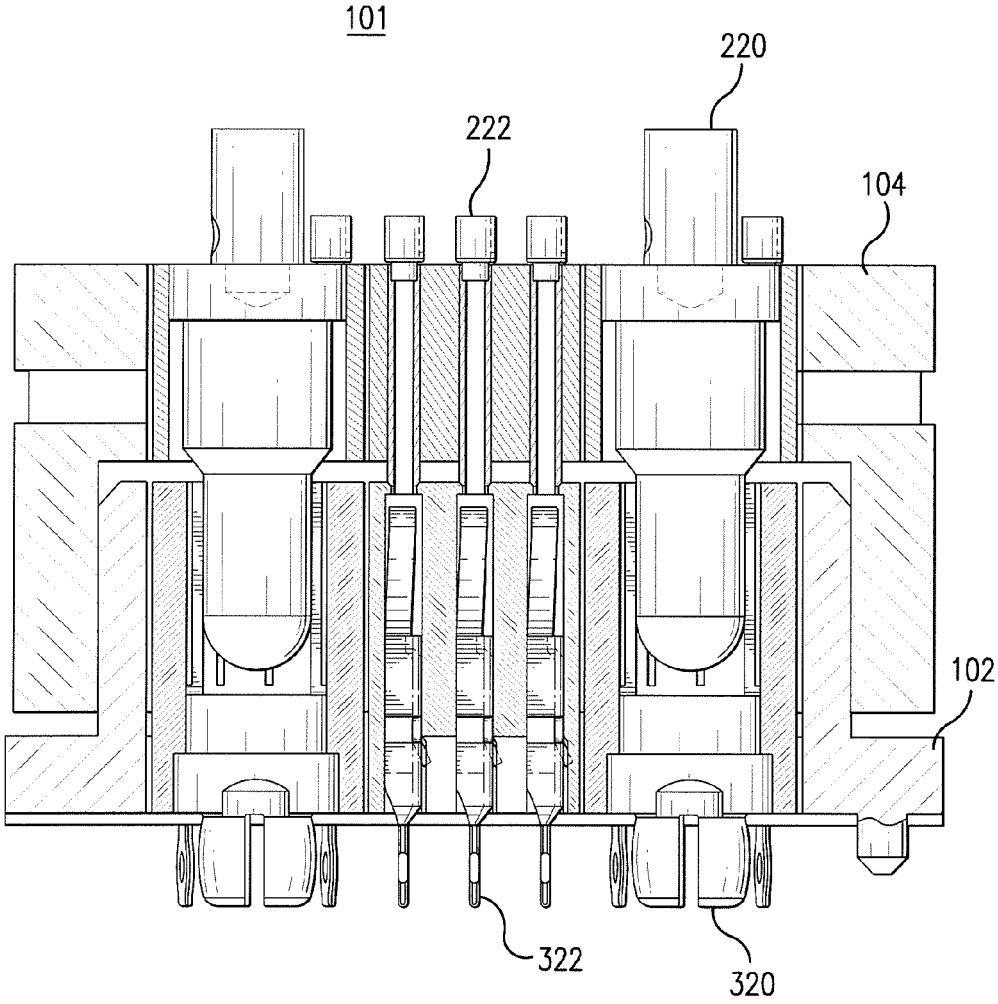

Referring now to FIG. 20, FIG. 20 is a cross-sectional view of connector assembly 101 showing adapter assembly 104 mated with header assembly 102. As shown in FIG. 20, when assemblies 102 and 104 are mated, the adapaters of header assembly 102 are positioned within the cavity formed by housing 204 and the bottom faces of insulators 211/212, which cavity is best seen in FIG. 10, the signal contacts 222 engage with the signal contacts 322, thereby electrically coupling the signal contacts, and the contacts 220 engage with contacts 320.

In some embodiments header assembly 102 and adapter assembly 104 include means for facilitating alignment of the header assembly 102 with the adapter assembly when the two are blind mated. For example, one such means is the float plate 106 attached to adapter assembly 104. Float plate 106 has a through hole 107 for receiving a screw or pin (e.g., shoulder screw) (not shown) that is used to floatably connect adapter assembly to a chassis or other component. That is, adapter assembly 104 is preferably not rigidly connected to the chassis, but rather connected so that it has some radial and/or axial float relative to the chassis. Thus, when header assembly 102 is brought to adapter assembly and there is some small amount of misalignment, adapter assembly can move position relative to the chassis and relative to the header assembly 102 to thereby achieve alignment.

Figure 21:
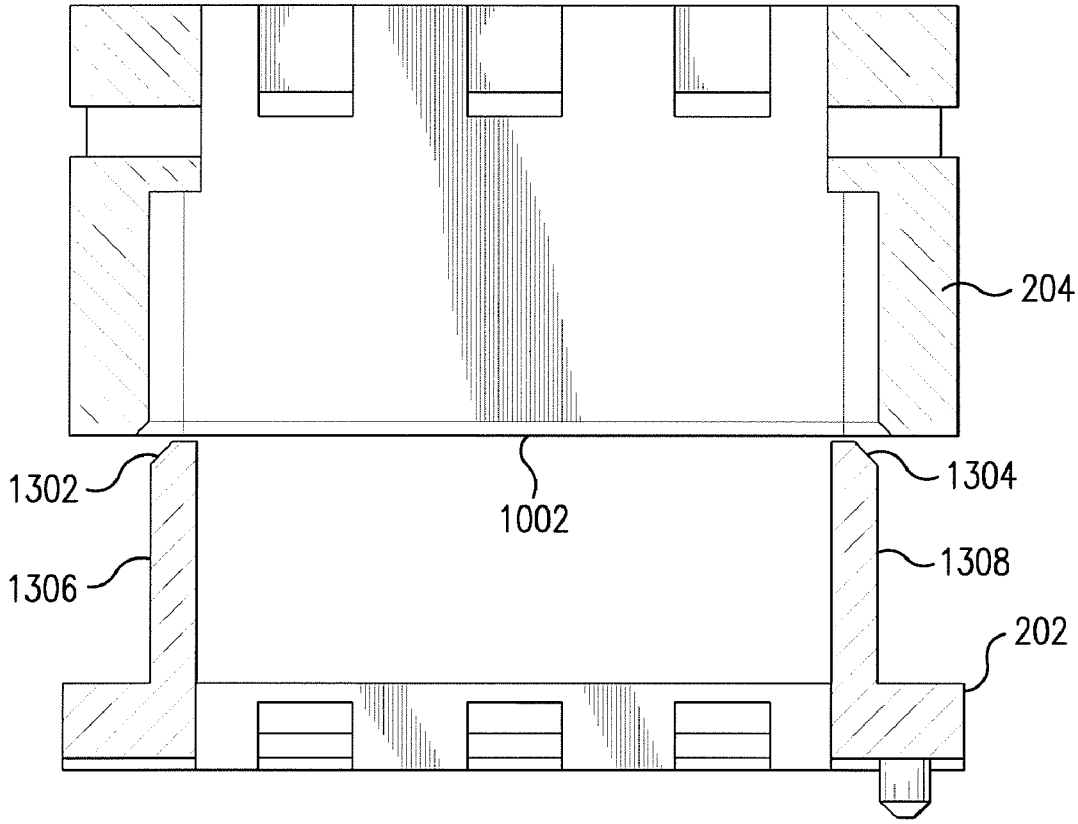
Figure 22:
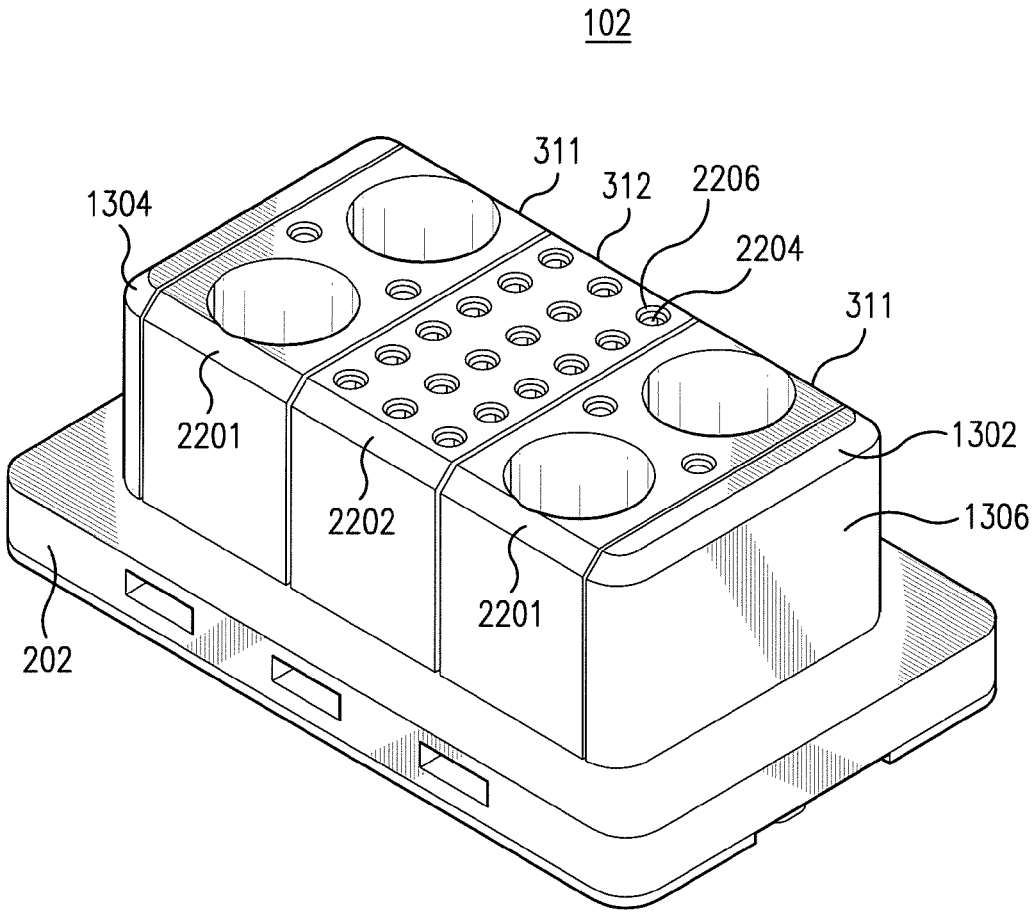

Other means for facilitating the correct alignment include: (a) an internal beveled edge 1002 (see FIG. 10) of adapter housing 204 and (b) beveled forward edges 1302, 1304 formed on walls 1306 and 1308, respectively. FIG. 21 shows housings 202 and 204 just prior to engagement and serves to illustrate how the beveled edge 1002 and beveled edges 1302, 1304 facilitate alignment. Still further means include the conical shaping of lead-in 1102 and the conical shaping of lead-in 1202. Additionally, through holes 614 are sized to allow contacts 222 to float slightly. Also, the signal contact through holes 2204 of signal insulator 312 have beveled edges 2206, as shown in FIG. 22. As further shown in FIG. 22, other means for facilitating the correct alignment include beveled edges 2201 and 2202 of insulators 311 and 312, respectively.

Figure 23:
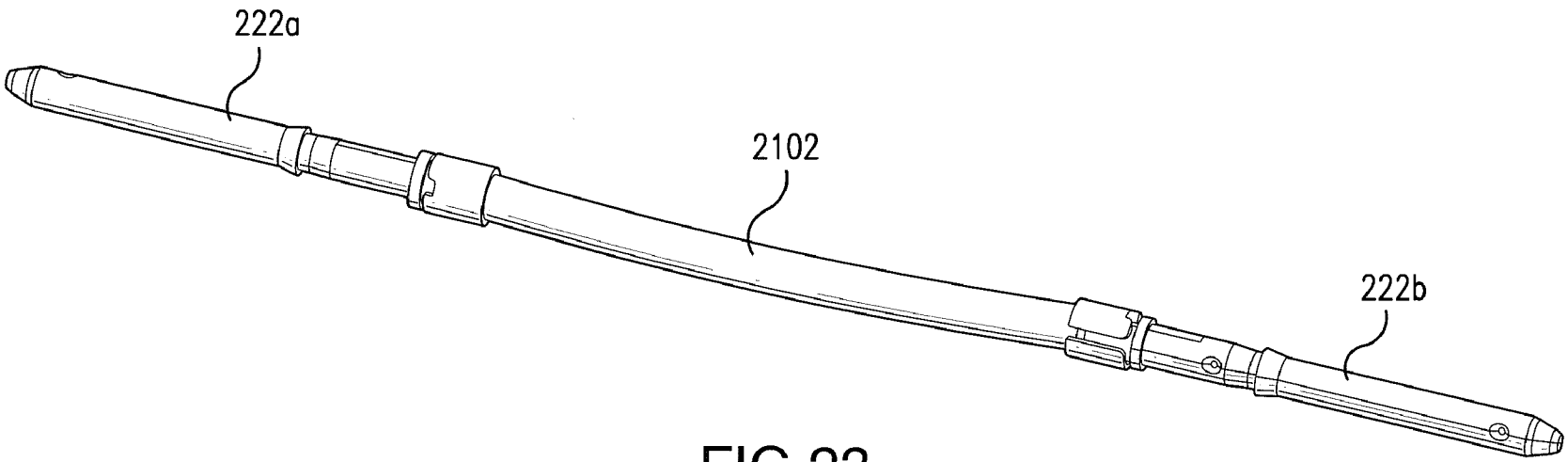
Figure 24:
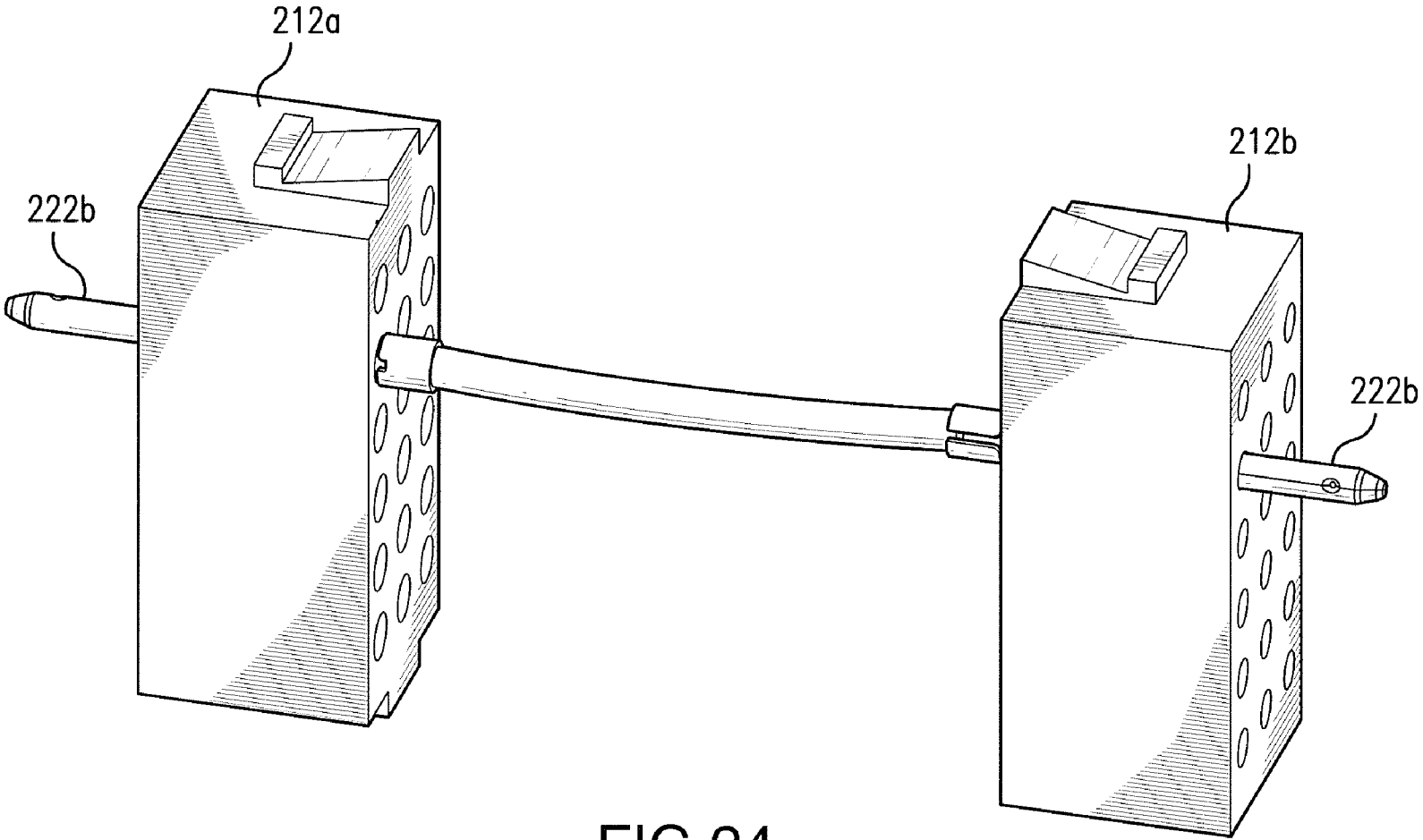
Figure 25:
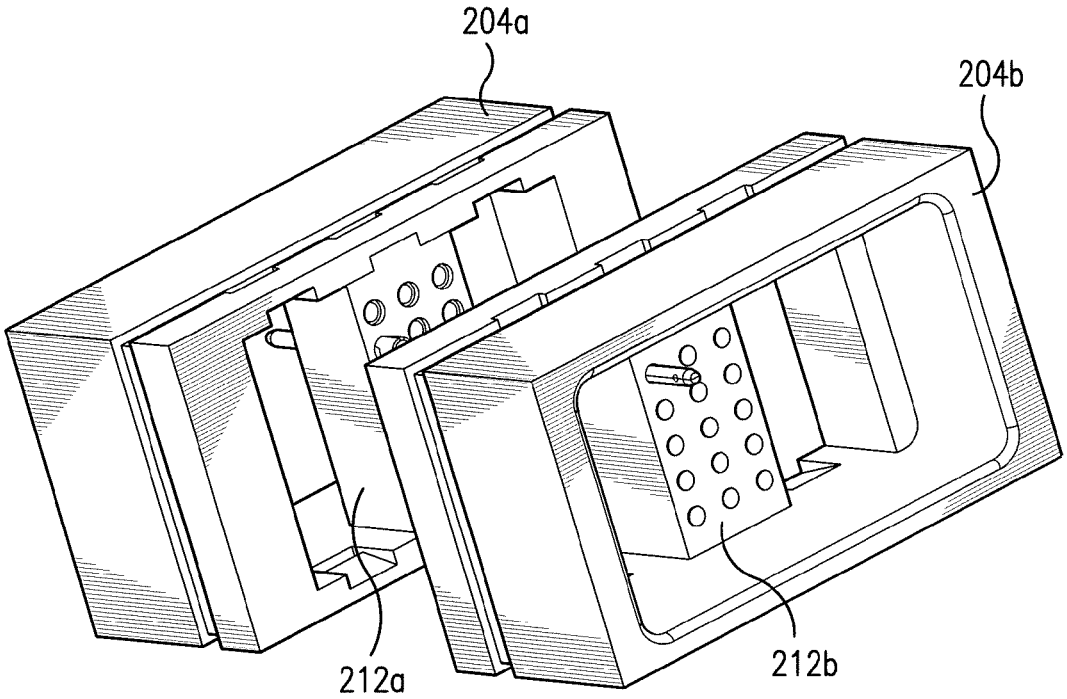
Figure 26:
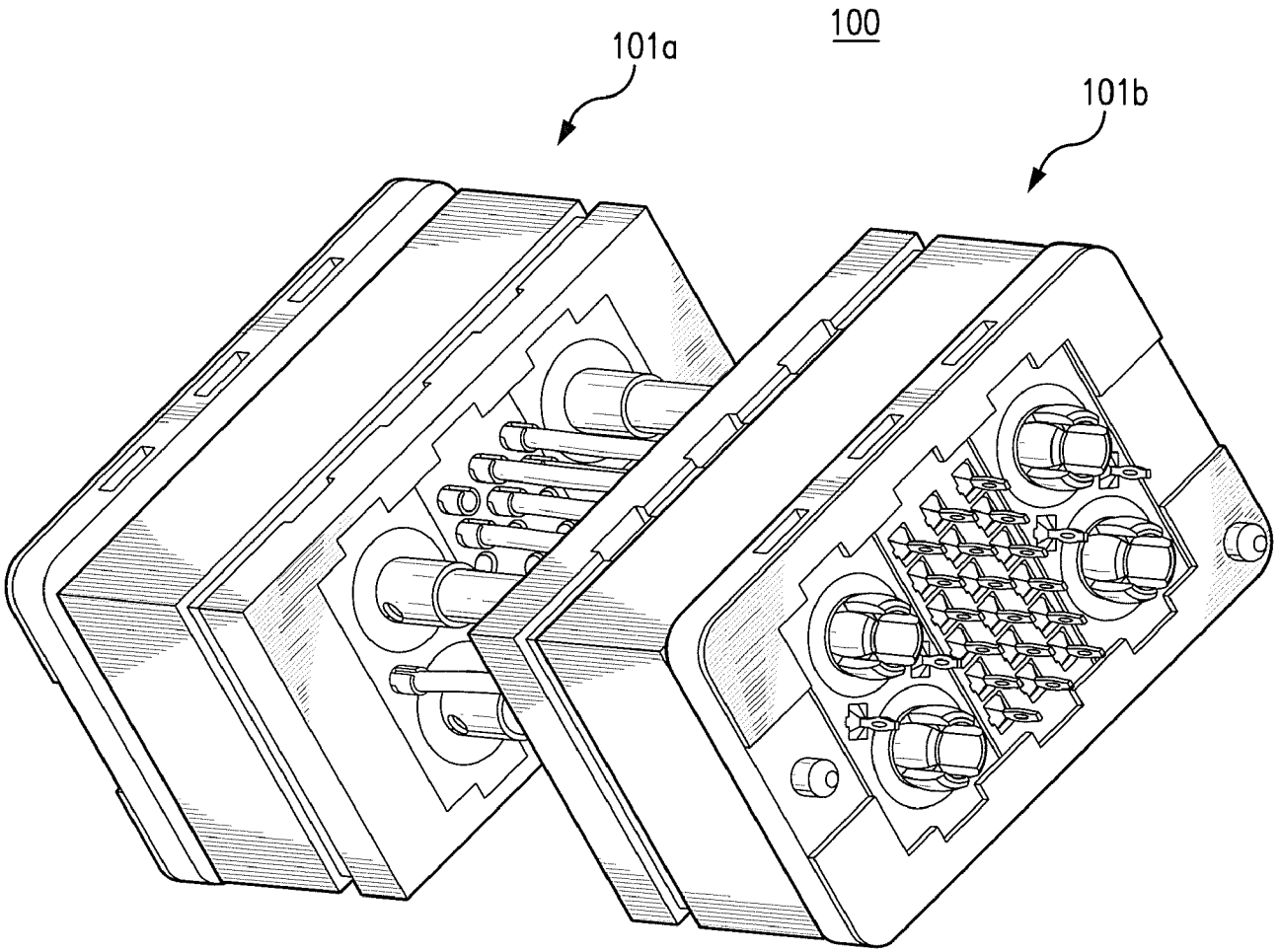

Referring now to FIGS. 23-26, these figures illustrate a process for making connector system 100. The process begins by connecting an end of a wire (e.g., insulated wire) to a contact 222*a* and connecting the other end of the wire to signal contact 222*b*. This step is repeated as many times as necessary. After this step, contact 222*b* is inserted into signal insulator 212*b* and contact 222*a* is inserted into a signal insulator 212*a* as shown in FIG. 21. Again, this step may be repeated until there are no more empty though holes in the insulators. Next, insulators 212*a,b* are inserted into adapter housings 204*a,b* respectively, as shown in FIG. 23. Other insulators as needed may also be inserted into housings 204*a, b*. For example, one may insert into housings 204*a,b*, respectively, a first power insulator 211*a* and a second power insulator 211*b*, wherein, prior to insertion, insulator 211*a* houses a power contact 220*a* that is electrically connected via a wire (or other means) to a power contact 220*b* housed in insulator 211*b*. Next, adapter assemblies 104*a,b* are mated with corresponding header assemblies 102*a,b*, respectively, such that the contacts of adapter assemblies 104*a,b* engage with corresponding contacts of header assemblies 102*a,b*, respectively (see FIG. 24).

The process of connecting plug 108 (see FIG. 1) to connector assembly 102*b* is similar. That is, for example, one end of a wire (e.g., wire 109) is attached to an end of a signal contact 222*b* and then the signal contact is inserted into an insulator through hole (e.g., hole 612 or 614). Preferably the step of inserting the contact in the through hole occurs prior to inserting in the adapter housing 204*b* the particular insulator in which the through hole is formed. The other end of the wire 109 may be connected to plug 108 or any other component.

Figure 27:
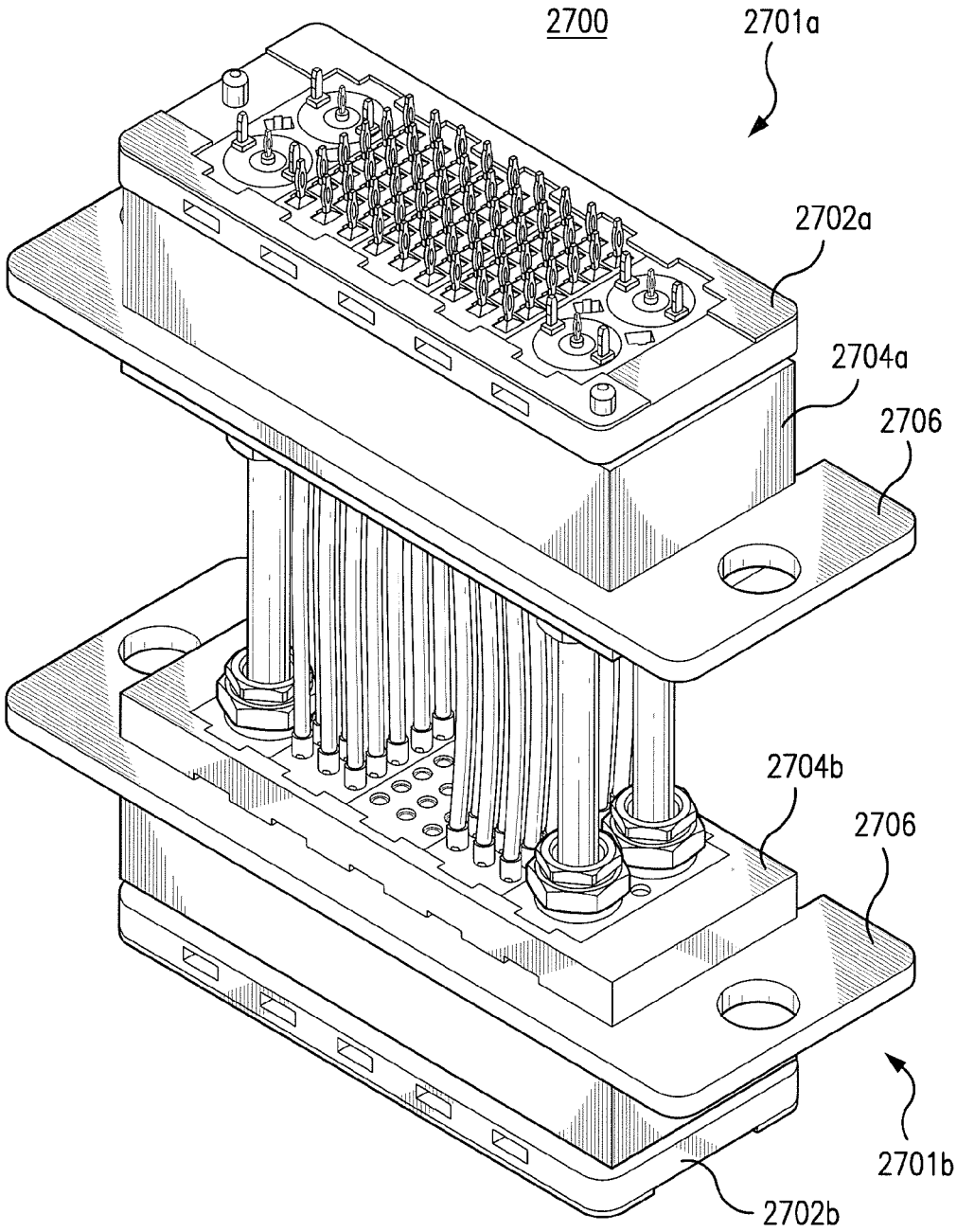
FIGS. 27-39 illustrate a connector system according to another embodiment of the invention.

Referring now to FIG. 27, FIG. 27 illustrates a connector system 2500 according to another embodiment. As shown, like connector system 100, connector system 2700 may include a first connector assembly 2701*a* electrically connected to a second connector assembly 2701*b*. Connector assembly 2701*a* may be substantially identical to connector assembly 2701*b*. Each connector assembly 2701 (i.e., connector assemblies 2701*a,b*) may include a header assembly 2702 and an adapter assembly 2704 (i.e., connector assembly 2701*a* may include header assembly 2702*a* and adapter assembly 2704*a* and connector assembly 2701*b* may include header assembly 2702*b* and adapter assembly 2704*b*). Each assembly 2701 may also include a float plate 2706 for connecting the adapter assembly 2704 to a chassis or other device.

Figure 28:
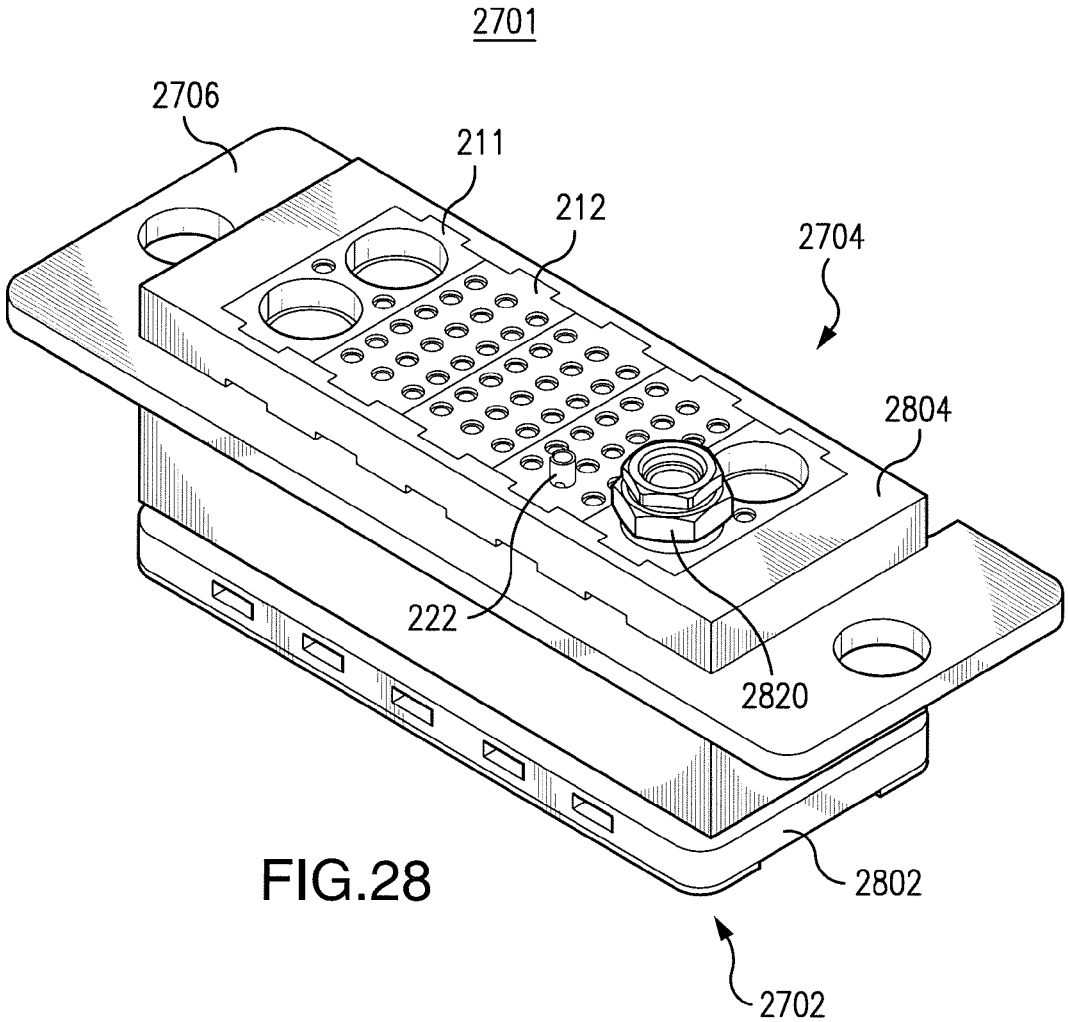

Referring now to FIG. 28, FIG. 28 is a top view of an exemplary connector assembly 2701. As shown, header assembly 2702 of the connector assembly 2701 may include a header housing 202 and adapter assembly 2704 may also include an adapter housing 2804 for housing various insulators (i.e., housings that house contacts and electrically insulate the contacts from one another). In the example shown, adapter housing 2804 is housing two power/RF insulators 211 and three signal insulators 212, the power/RF insulators 211 may house an RF contact 2820 and two signal contacts 222, and the signal insulator 212 may house a number of signal contacts 222 (e.g., eighteen signal contacts).

Figure 29:
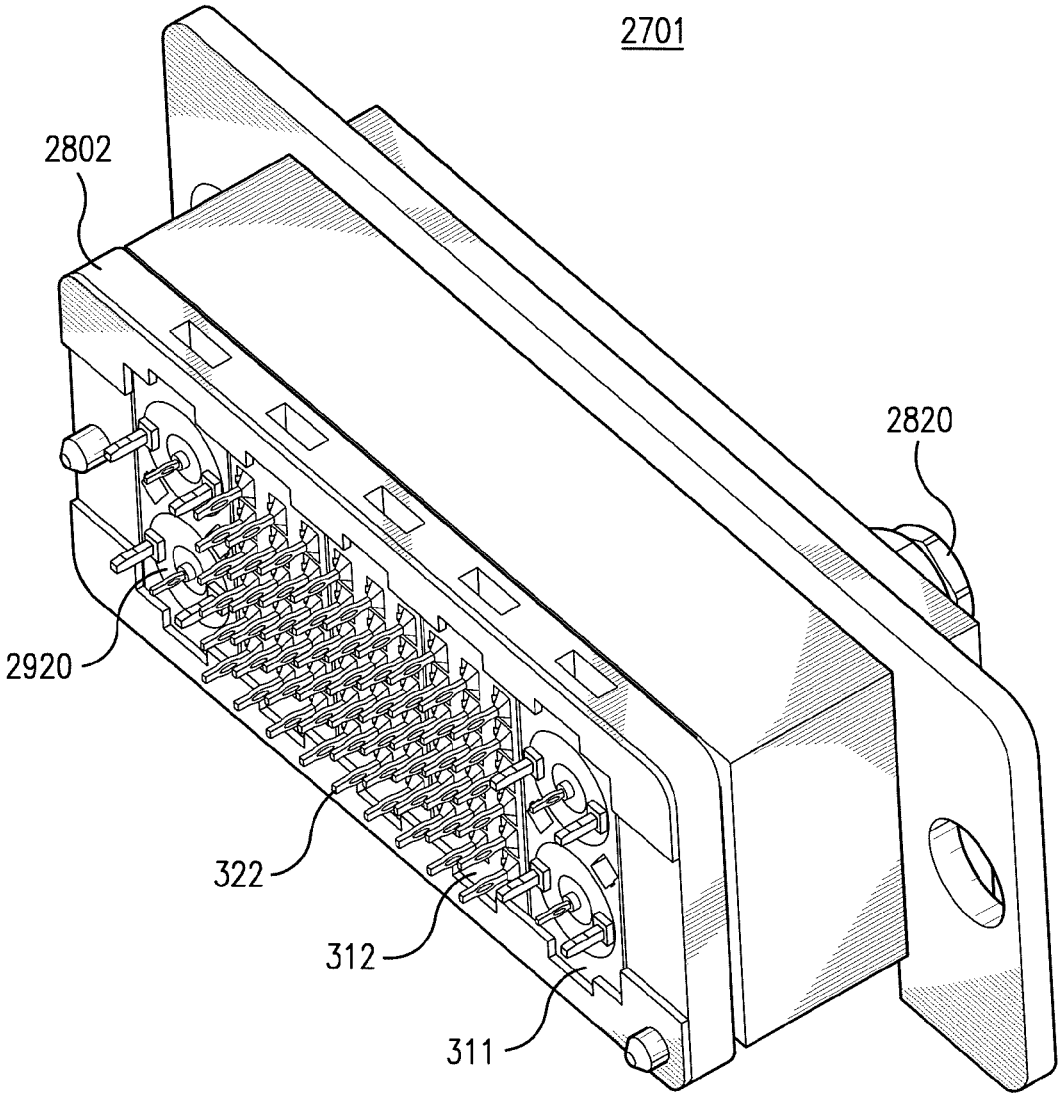
Figure 30:
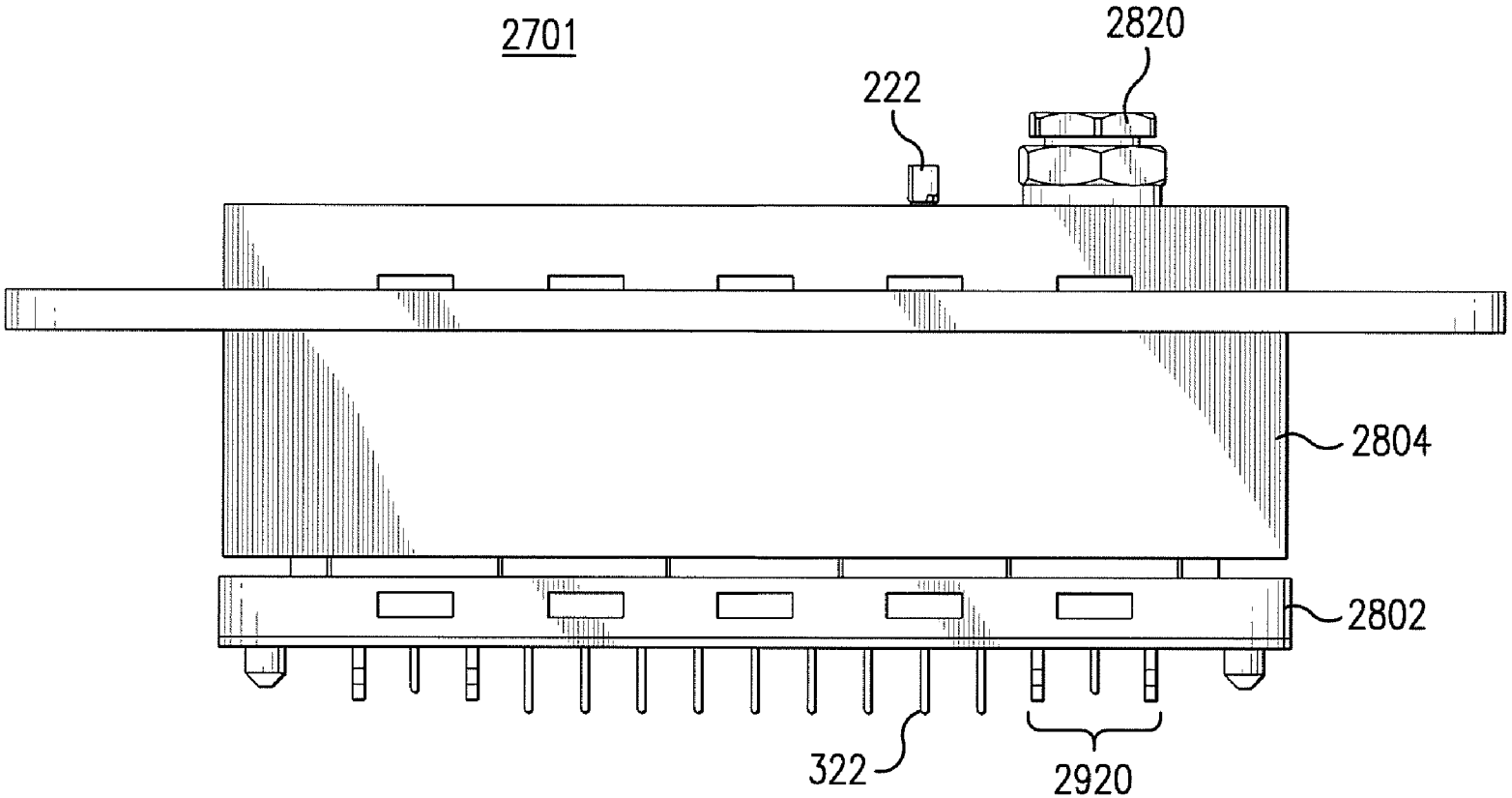

Referring now to FIG. 29, FIG. 29 is a bottom view of the exemplary connector assembly 2701. In the example shown, housing 2802 is housing two power/RF insulators 311 and three signal insulators 312, the power/RF insulators 311 are housing two power contacts 320 and two signal contacts 322, and the signal insulators 312 are housing a number of signal contacts 322. FIG. 30 is a side view of connector assembly 2701.

Figure 31:
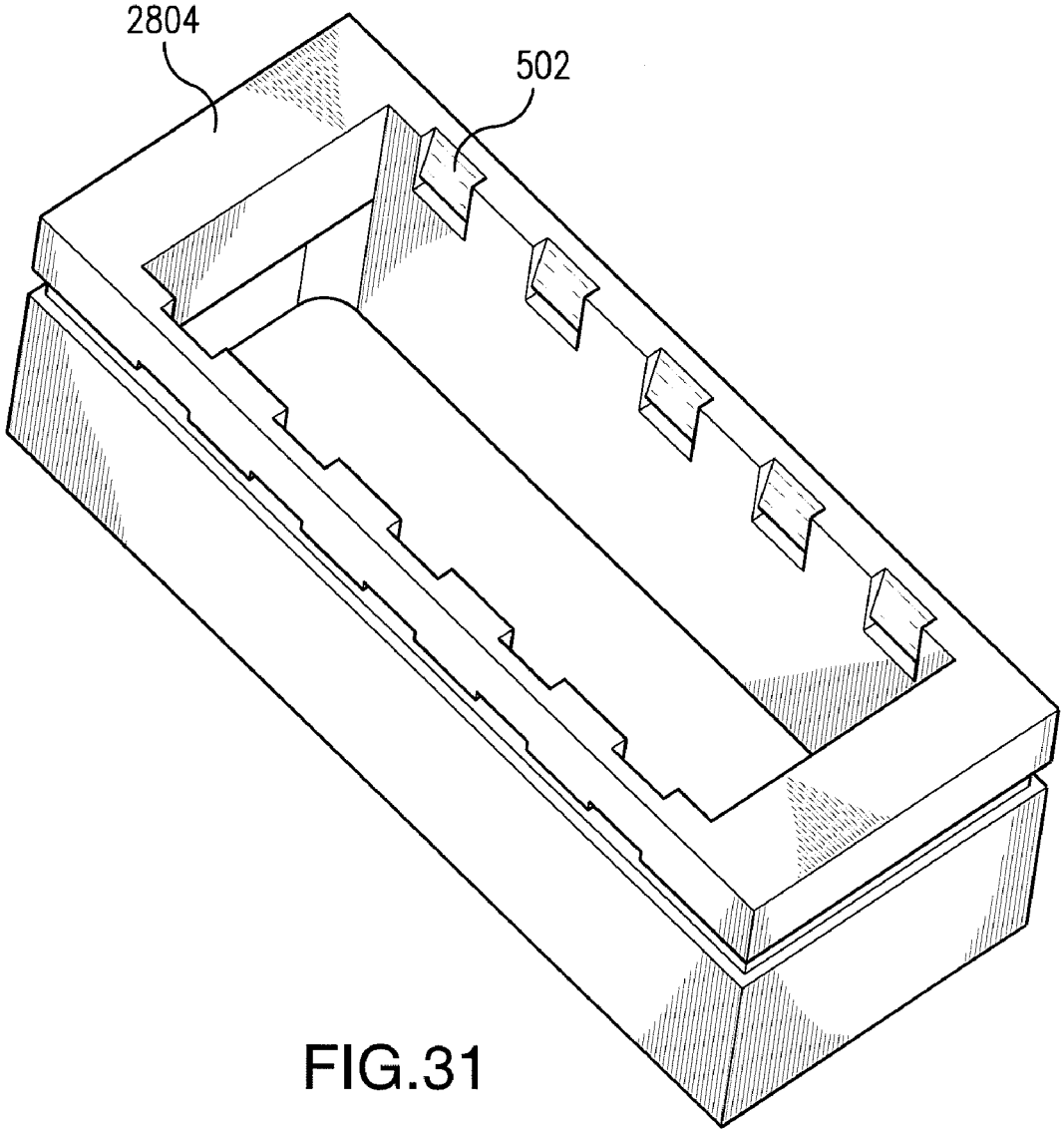

Referring now to FIG. 31, FIG. 31 is a view of an exemplary adapter housing 2804. In the embodiment shown, housing 2804 is a generally rectangular housing open at opposite side thereof having two end walls and two side walls, and the side walls include grooves 502 for receiving a locking tab 602 (see FIG. 6) formed on a side wall of an insulator. The depth of the groove 502 decreases as the groove 502 proceeds inwardly, thereby forming a ramp structure. This facilitates the locking of an insulator in the adapter housing.

Figure 32:
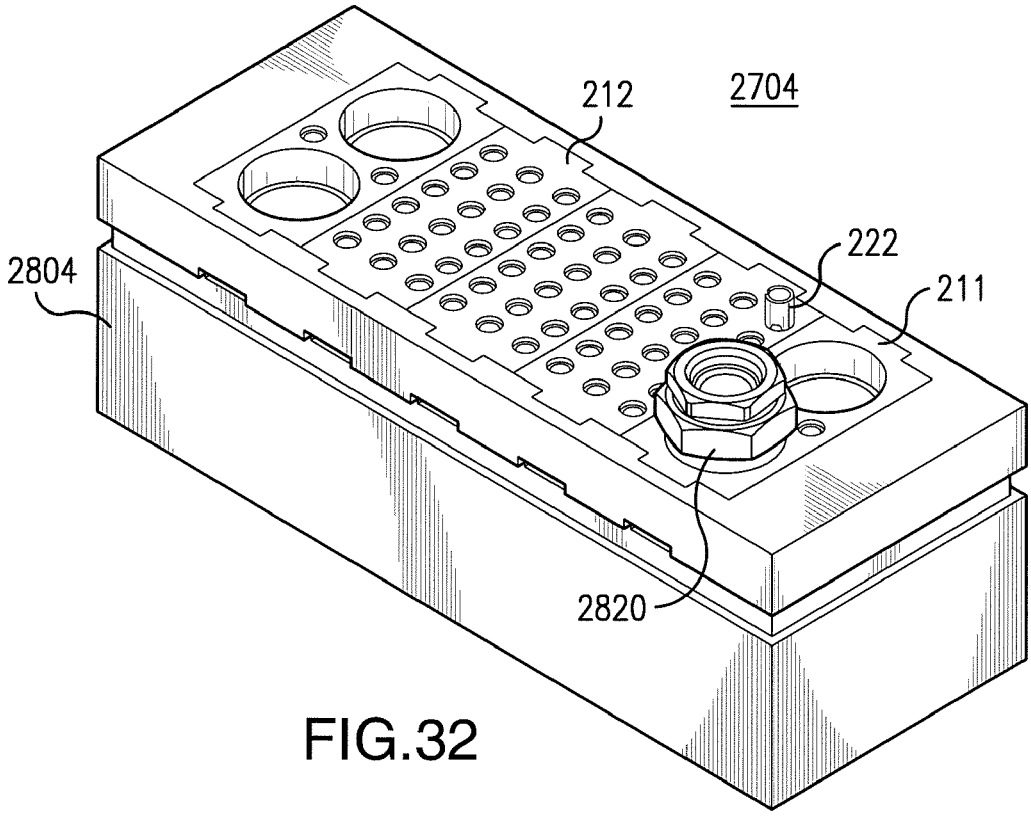
Figure 33:
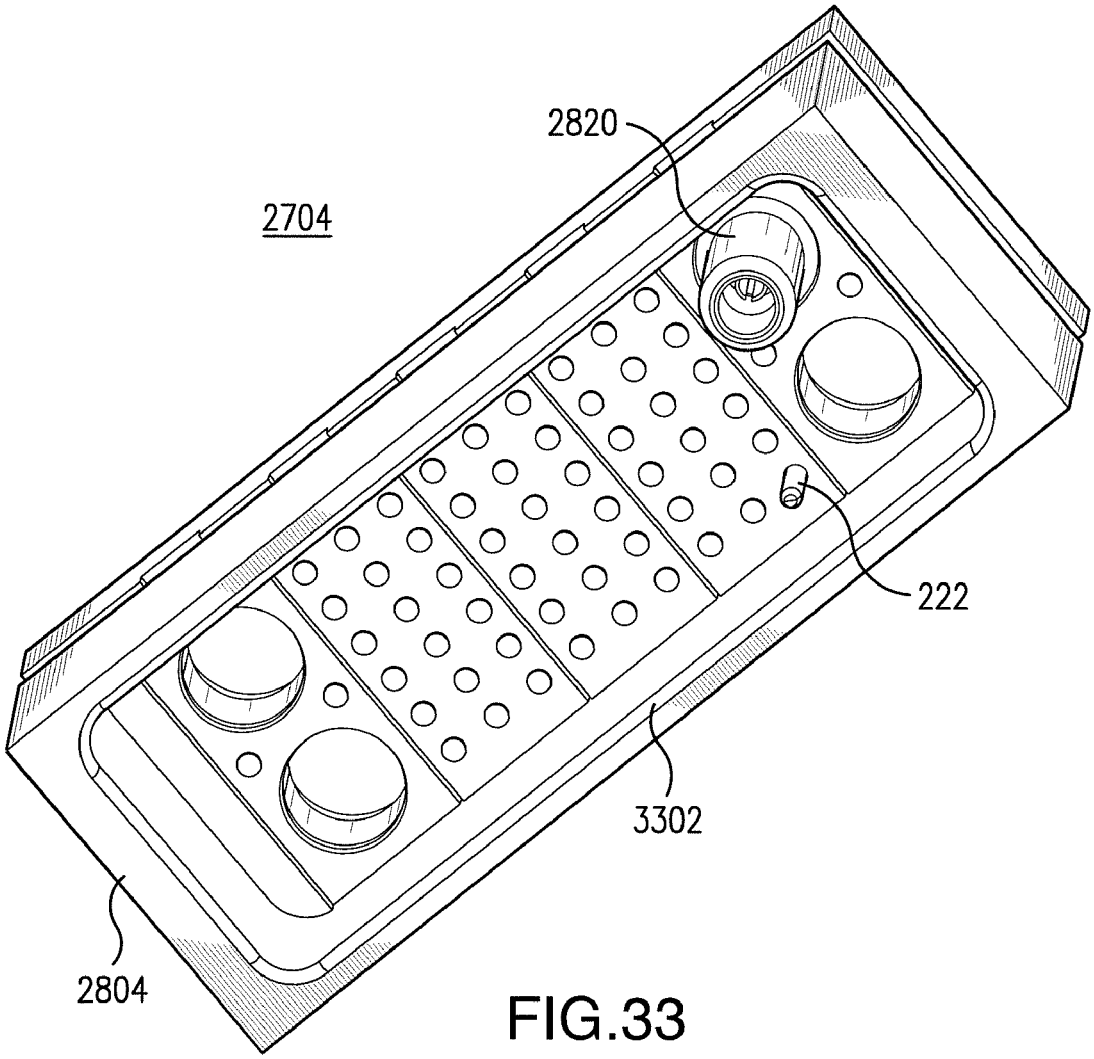

FIG. 32 is a top view of adapter assembly 2704 and shows an exemplary signal contact 222 inserted into a through hole 614 of signal insulator 212. FIG. 9 also shows an exemplary RF contact 2820 inserted into a through hole 611 of power/RF insulator 212. FIG. 33 is a bottom view of adapter assembly 2704 and shows that an end portion of RF contact 2820 and an end portion of signal contact 222 passes entirely through the through holes 611 and 614, respectively. That is the end portions of contacts 2820 and 222 extend beyond the bottom face of insulators 211 and 212, respectively. Insulators 211 and 212 and contacts 2820 and 222 configured like this so that the end portions of the contacts can mate with corresponding contacts of the header assembly 2702.

While in FIG. 32 adapter assembly 2704 is shown has having two power insulators 211 and three single signal insulators 212 arranged between the power insulators, the invention is not so limited. In fact, an advantage of adapter assembly 2704 is that it is extremely adaptable. That is, the type of insulators that may be housed in adapter housing 204 and the arrangement of said insulators in the housing is entirely up to the end user.

Figure 34:
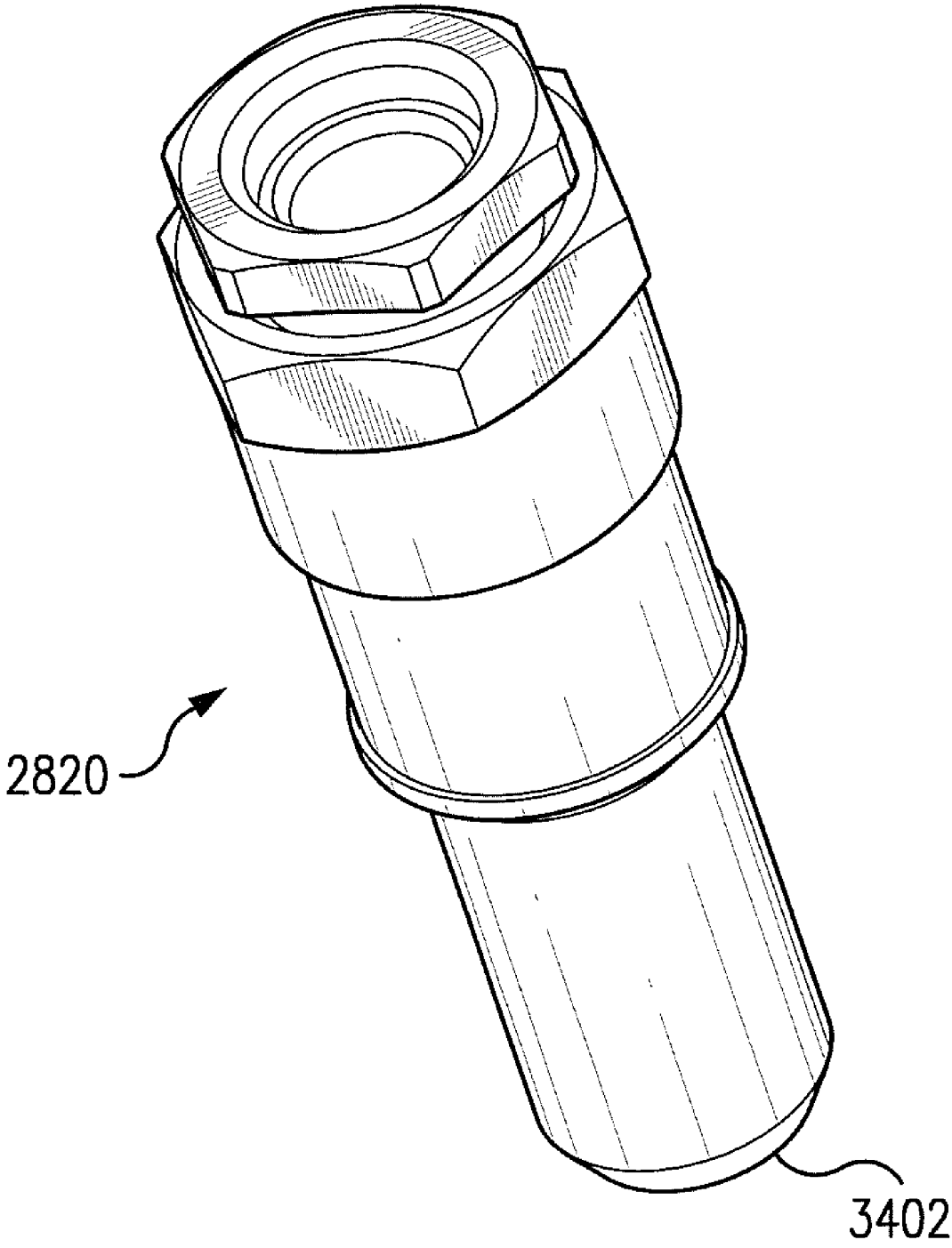
Figure 35:
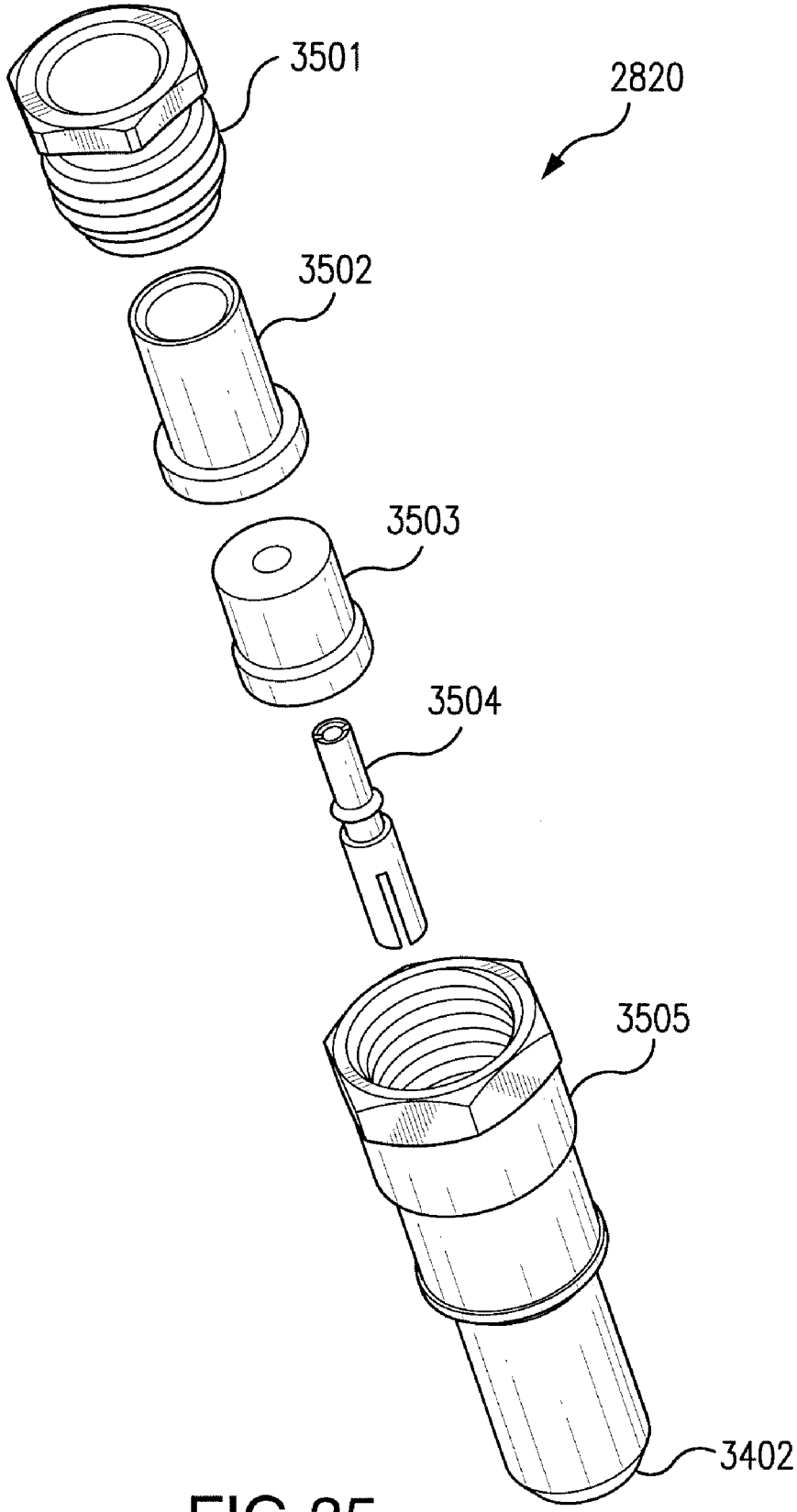
Figure 36:
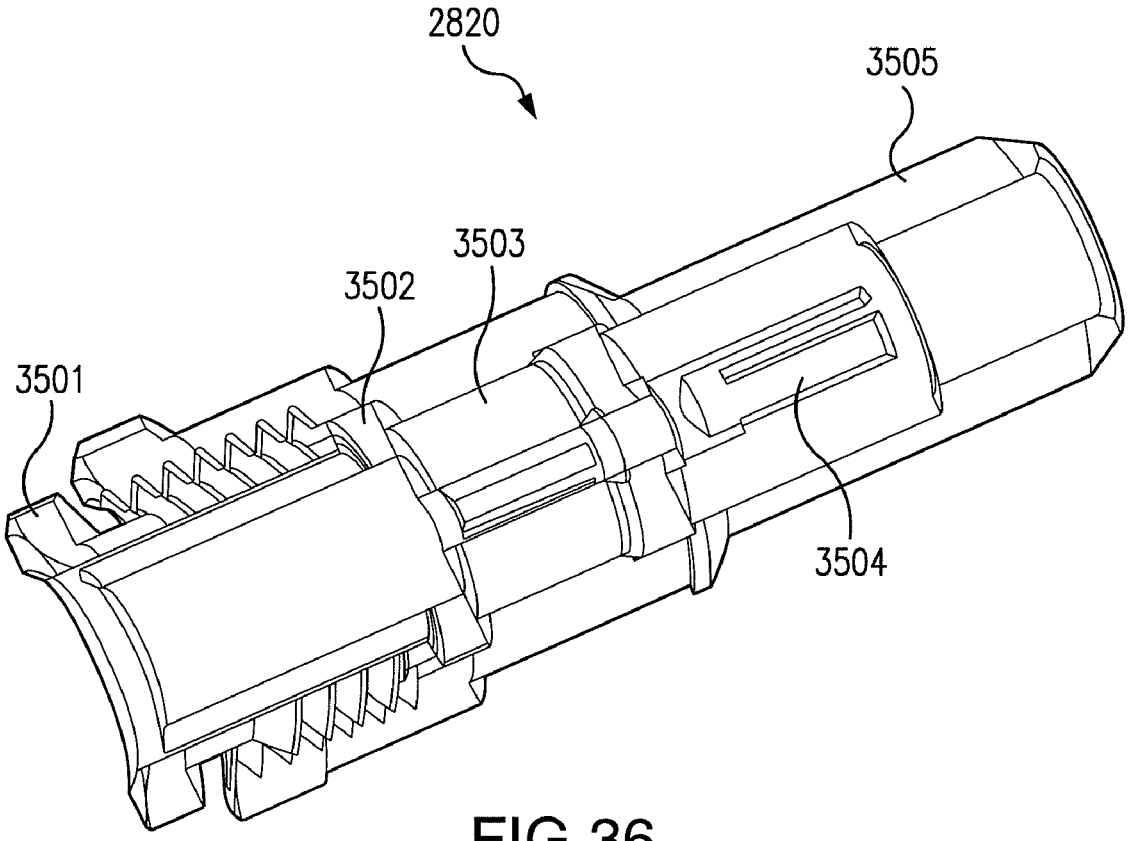

FIG. 34 illustrates an exemplary RF contact 2820, which, in the embodiment shown, includes a conical shaped lead-in 3402, which functions to facilitate alignment between assemblies 2702 and 2704. FIG. 35 is an exploded view of RF contact 2820 according to some embodiments. In the embodiment shown, RF contact 2820 includes: a clamp nut 3501; a crimp sleeve 3502; a dielectric (e.g., a Teflon dielectric) 3503; a signal contact 3504 and an outer body 3505. FIG. 36 is a cross-sectional view of the RF connector shown in FIGS. 34 and 35.

Figure 37:
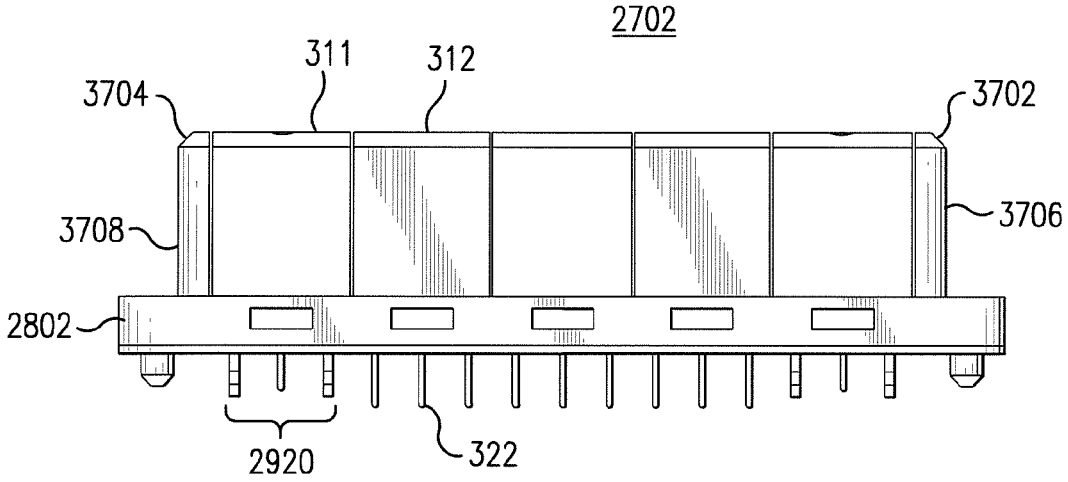

Referring now to FIG. 37, FIG. 37 illustrates an exemplary header assembly 2702. Like adapter assembly 2704, header assembly includes a header housing 2802 for housing power/RF insulators 311 and/or signal insulators 312. In the example, shown, because adapter assembly 2704 includes three signal insulators 212 sandwiched between two power insulators 211, header assembly 2702 also includes three signal insulators 312 sandwiched between two power insulators 311.

Figure 38:
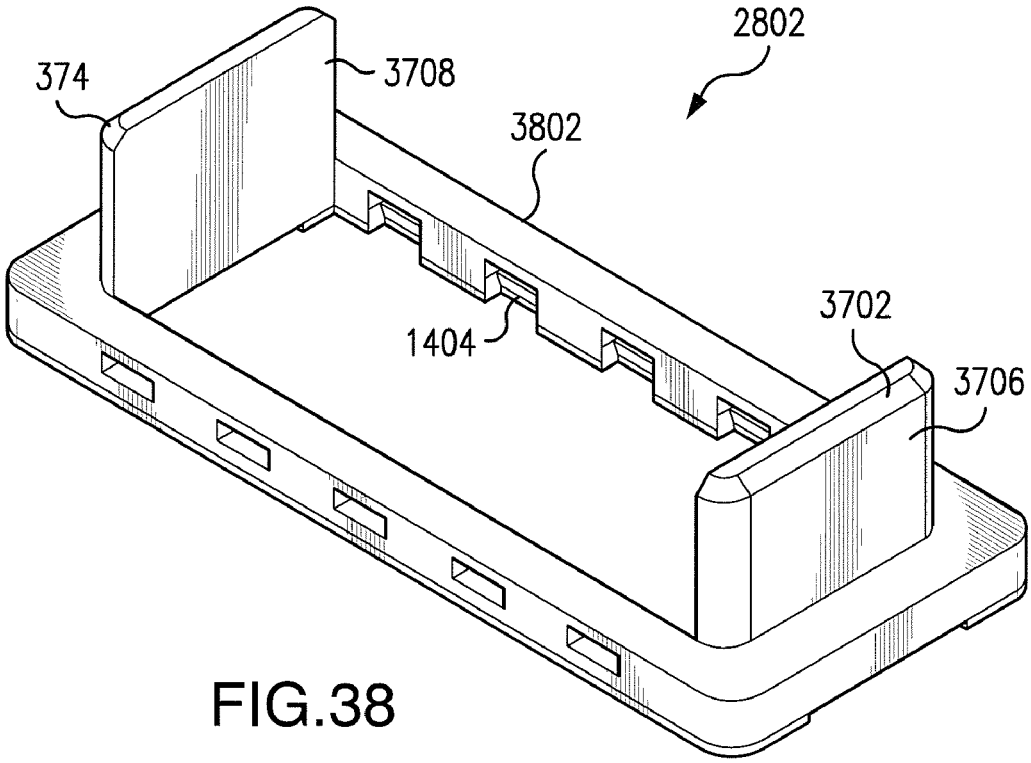

FIG. 38 further illustrates header housing 2802. Header housing 2802 includes a generally rectangular frame 3802 having two parallel end walls and two parallel side walls, and the side walls include grooves 1404 for receiving a locking tab (see e.g., element 602 in FIG. 6) formed on a side wall of an insulator. As also shown, housing 2802 includes two parallel side walls 3706, 3708 that face each other and extend outwardly from the end walls of frame 3802.

Figure 39:
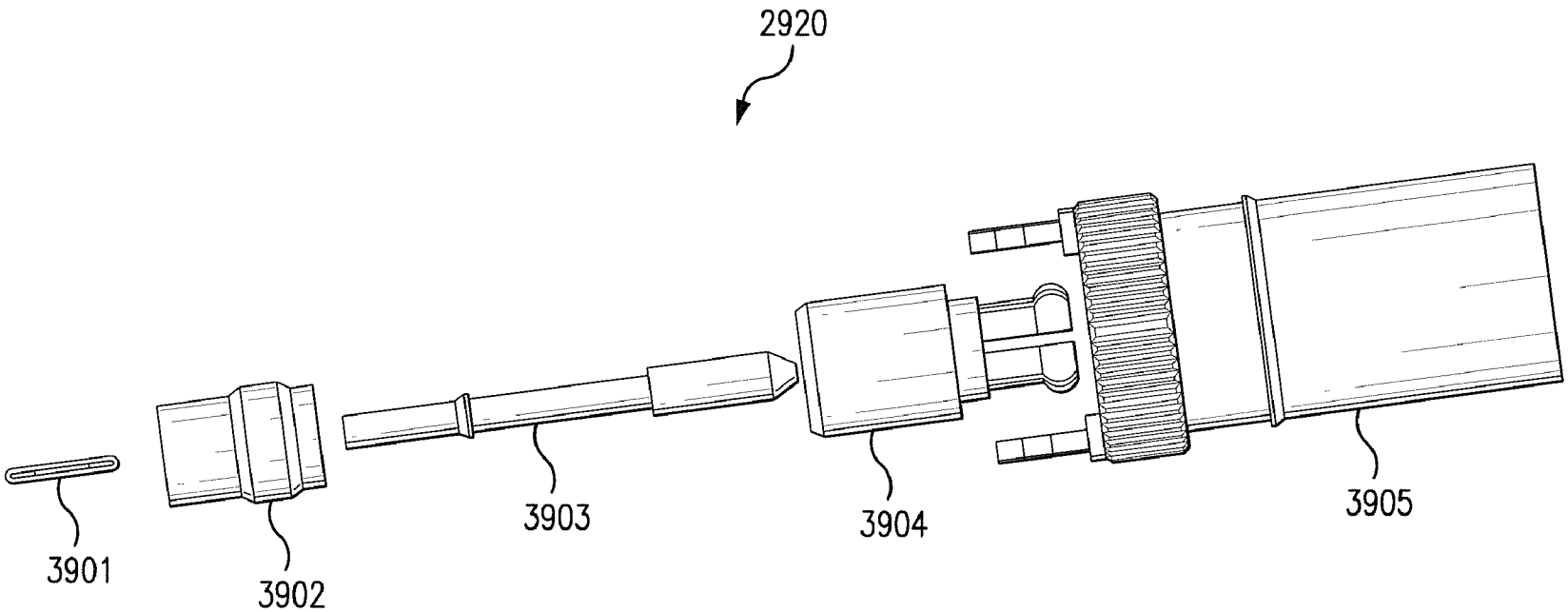

FIG. 39 illustrates RF contact 2920 according to some embodiments. As shown in FIG. 39, RF contact includes: a compliant member 3901; a dielectric 3902; a signal contact 3903; a outer contact 3904 and a n outer body 3905.

In some embodiments header assembly 2702 and adapter assembly 2704 include features that facilitate alignment of the header assembly with the adapter assembly when the two are blind mated. For example, like float plate 106, float plate 2706 is attached to adapter assembly 2704 and is used to floatably connect adapter assembly to a chassis or other component. Other features that facilitate correct alignment include an internal beveled edge 3302 (see FIG. 33) of adapter housing 2804 and beveled forward edges 3702, 3704 formed on walls 3706 and 3708, respectively. Still further features include the conical shaping of lead-in 3402.

Figure 40:
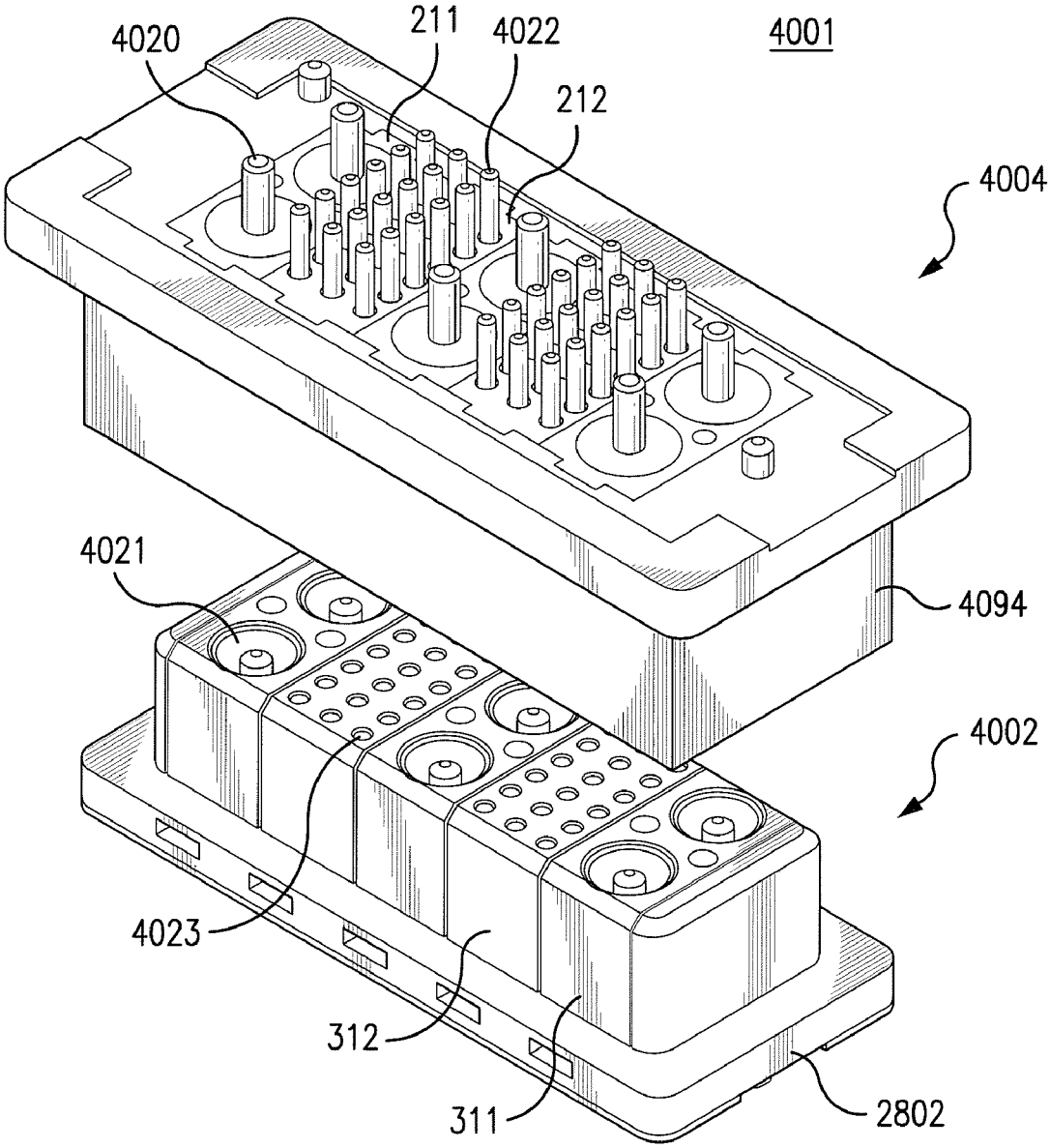
FIGS. 40-42 illustrate a connector system according to yet another embodiment of the invention.

Referring now to FIG. 40, FIG. 40 illustrates a connector assembly 4001 according to another embodiment. As shown, like connector assembly 2701, connector assembly 4001 may include a header assembly 4002 and an adapter assembly 4004. In this embodiment, adapter assembly 4004 is also a header assembly because it is designed to connect directly to a printed circuit board, but to avoid confusion we shall refer to assembly 4004 as the adapter assembly 4004.

Connector assembly 4001 is almost identical to connector assembly 2701. For example, connector assembly 4001 includes: (a) an adapter housing 4094 for housing insulators 211 and 212 in the same manner that housing 2804 houses the insulators and (b) header housing 2802 for housing insulators 311 and 312. A difference between connector assembly 4001 and connector assembly 2701 is that different contacts are housed in the insulators. For example, as shown in FIG. 40, insulator 211 holds power contacts 4020, insulator 212 holds signal contacts 4022, insulator 311 holds power contacts 4021, and insulator 312 holds signal contacts 4023.

Figure 41:
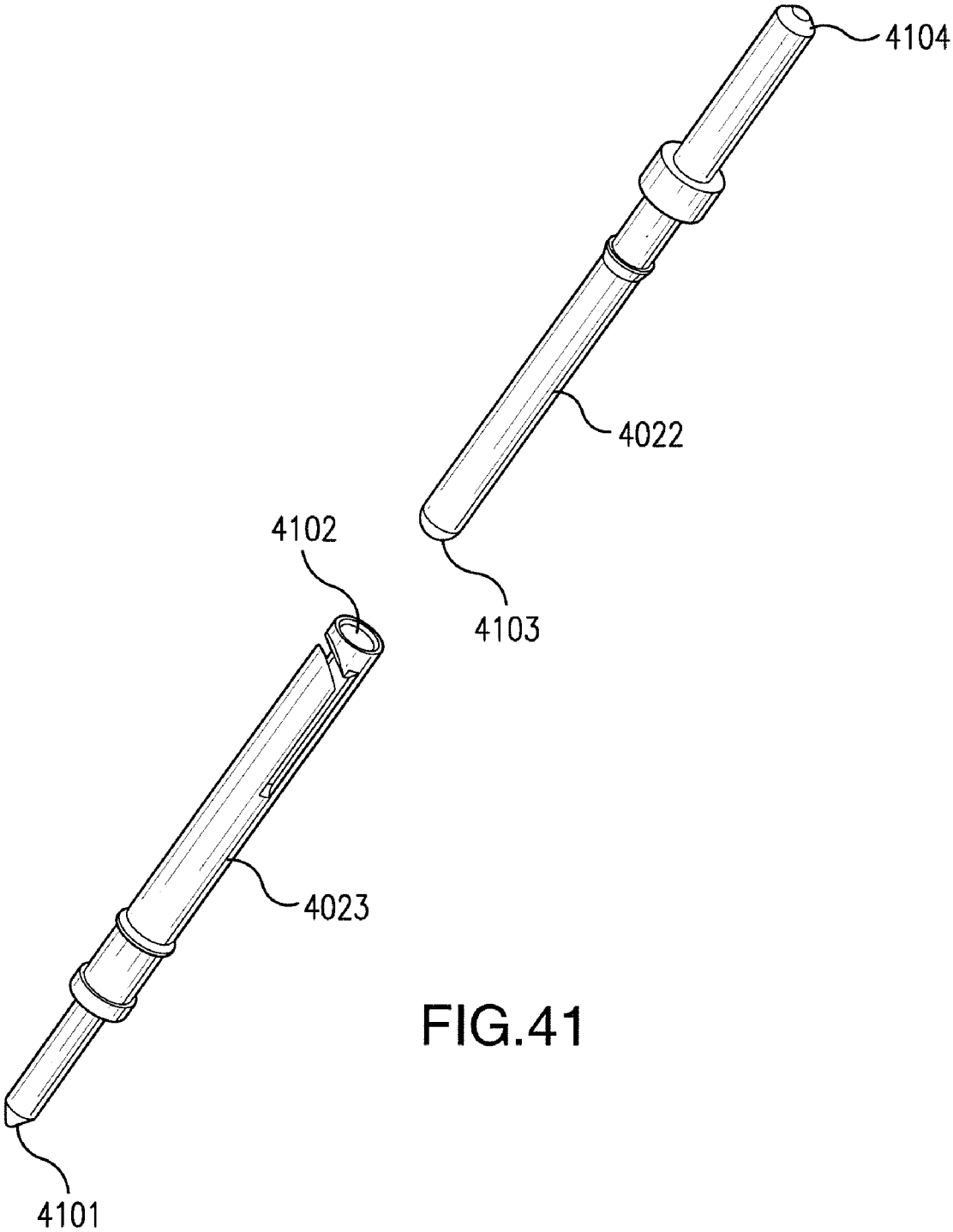
Figure 42:
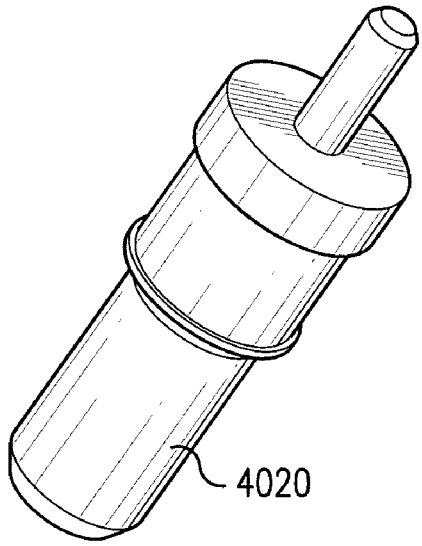
Figure 42:
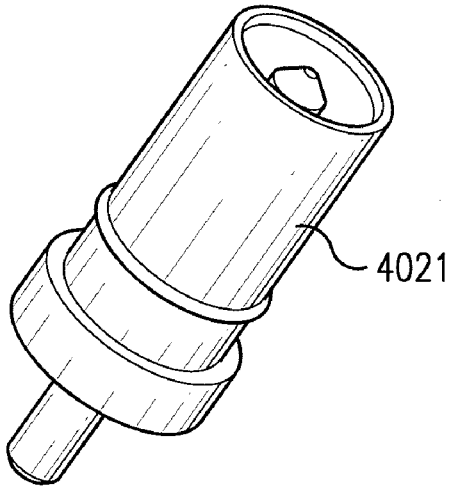

FIG. 41 further illustrates signal contacts 4022 and 4023. As shown in FIG. 41, contact 4022 is elongate and its tips 4103, 4104 are conical. Likewise, contact 4023 is elongate and has a conical tip 4101. The other end of contact 4023 (see element labeled 4102) defines an opening for receiving end 4103 of contact 4022. FIG. 42 further illustrates power contacts 4020 and 4021.

Figure 43:
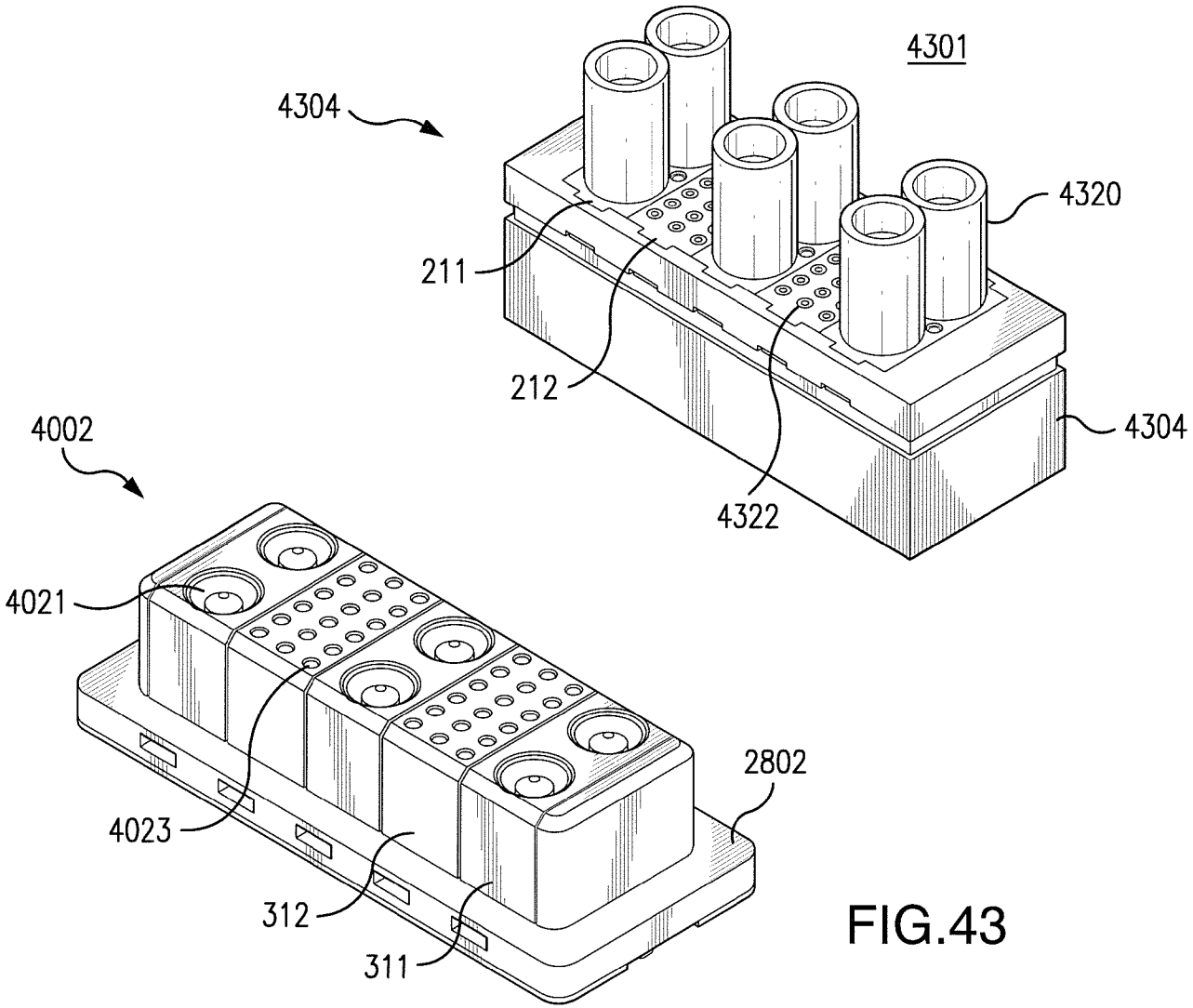
FIGS. 43-45 illustrate a connector system according to yet another embodiment of the invention.

Referring now to FIG. 43, FIG. 43 illustrates a connector assembly 4301 according to another embodiment. As shown, like connector assembly 101, connector assembly 4301 may include header assembly 4002 and an adapter assembly 4304. Adapter assembly 4304 is nearly identical to header assembly 2704. For example, adapter assembly 4304 includes adapter housing 4304 for housing insulators 211, 212. A difference between adapter assembly 4304 and adapter assembly 2704 is that adapter assembly includes different contacts than adapter assembly 2704. For example, as shown in FIG. 43, insulator 211 holds power contacts 4320, and insulator 212 holds signal contacts 4322.

Figure 44:
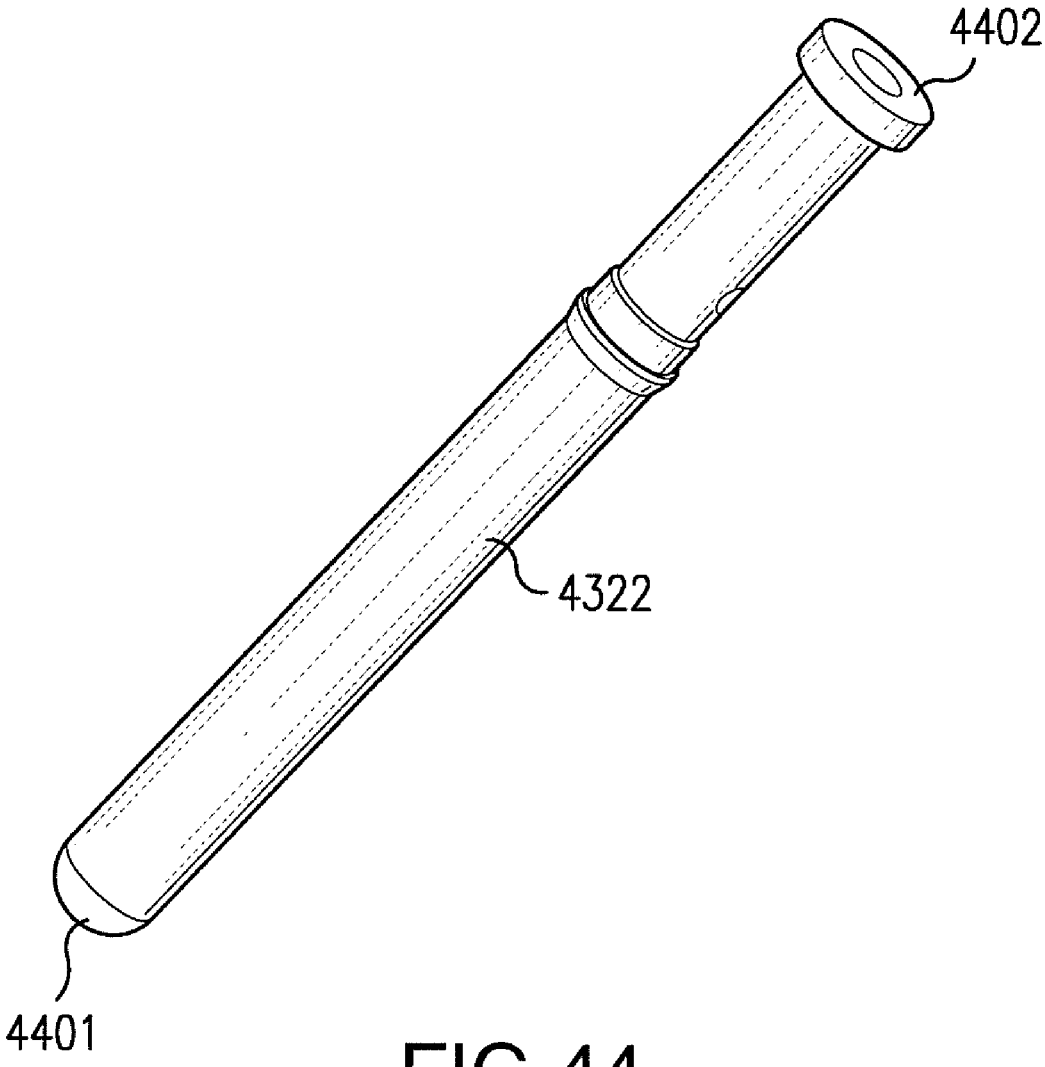

FIG. 44 further illustrates signal contact 4322. As shown in FIG. 44, contact 4322 is elongate and has a conical tip 4401. The other end of contact 4322 (see element labeled 4402) defines an opening for receiving another contact (e.g., the end of a wire)

Figure 45:
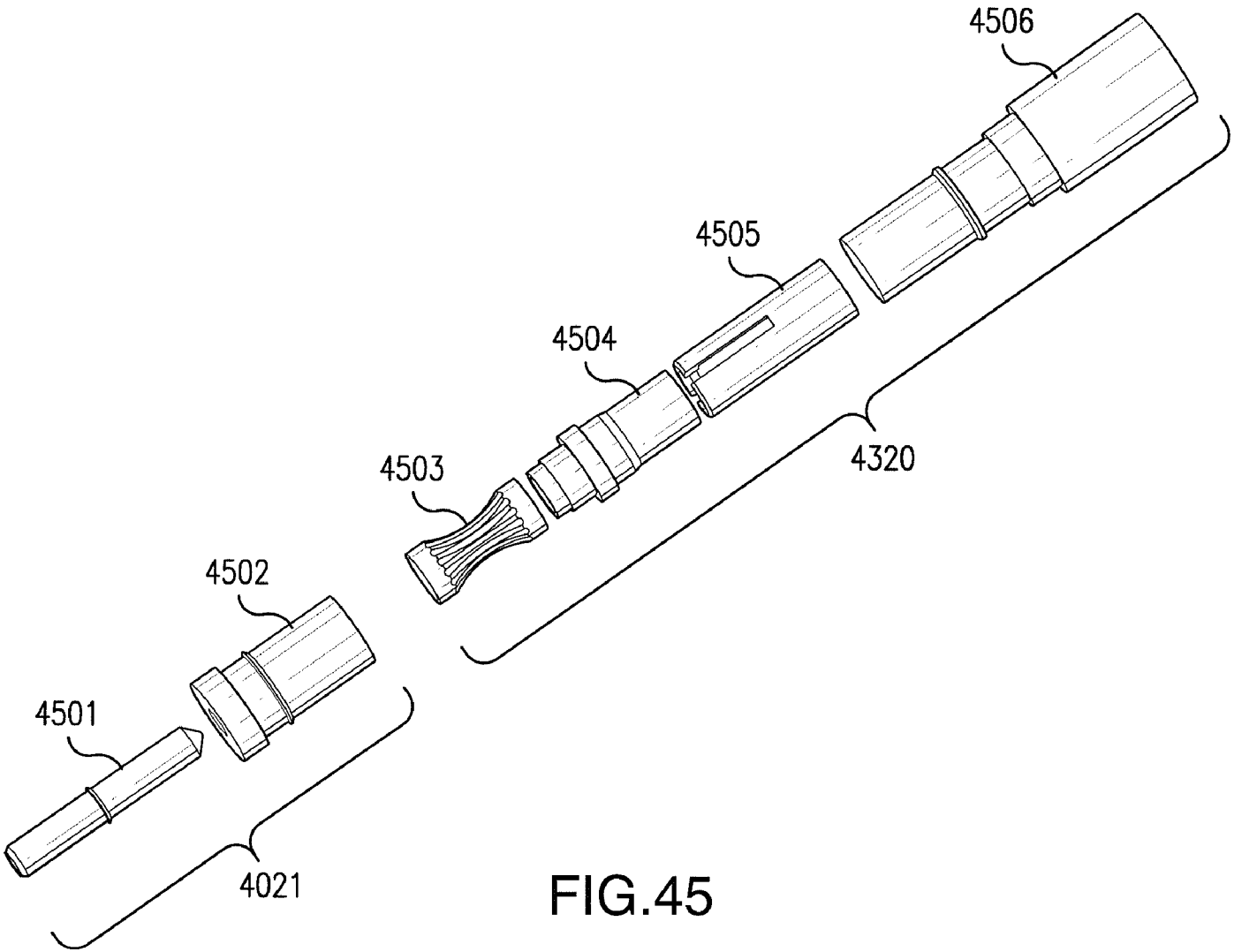

FIG. 45 shows exploded views of power contacts 4021 and 4320. As shown in FIG. 45, contact 4021 includes an dielectric 4502 for housing a contact 4501. Power contact 4320 includes: a contact element 4503; a rear body 4504; a front contact 4505; and a dielectric 4506.

While various embodiments of the present invention have been described above, it should be understood that they have been presented by way of example only, and not limitation. Thus, the breadth and scope of the present invention should not be limited by any of the above-described exemplary embodiments.

The invention claimed is:

1. An connector assembly, comprising:

an adapter assembly; and a header assembly configured to connect to a circuit board and configured to mate with the adapter assembly, wherein the adapter assembly comprises:

an adapter housing having an aperture for receiving other housings;

a first power/RF housing disposed in the aperture of the adapter housing, the first power/RF housing having an aperture for receiving a power or RF contact; and a first power or RF contact disposed in the aperture of the first power/RF housing;

a first signal housing disposed in the aperture of the adapter housing, the first signal housing having a first row of apertures and a second row of apertures; and a first set of signal contacts, each contact in said first set of signal contacts being disposed in one of said apertures of the first signal housing; and the header assembly comprises:

a header housing;

a second power/RF housing housed by the header housing, the second power/RF housing having an aperture for receiving a power or RF contact;

a second power or RF contact disposed in the aperture of the second power/RF housing, the second power or RF contact being electrically connected with the first power or RF contact;

a second signal housing housed in the header housing, the second signal housing having a first row of apertures and a second row of apertures; and a second set of signal contacts, each contact in said second set of signal contacts being disposed in one of said apertures of the second signal housing and being electrically connected with a signal contact from the first set of signal contacts.

2. The apparatus of claim 1, further comprising a float plate attached to the adapter assembly, said float plate being configured to floatably connect the adapter assembly to a frame.

3. The apparatus of claim 1, wherein the adapter assembly comprises means for facilitating alignment of the header assembly with the adapter assembly.

4. The apparatus of claim 3, wherein the header assembly comprises means for facilitating alignment of the header assembly with the adapter assembly.

5. The apparatus of claim 3, wherein the second power/RF housing and the second signal housing each comprises means for facilitating alignment of the header assembly with the adapter assembly.

6. The apparatus of claim 1, wherein the first signal housing includes a locking tab formed on a side wall of the first signal housing, and the adapter housing includes a groove that receives the locking tab.

7. The apparatus of claim 1, wherein the first power/RF housing includes a locking tab formed on a side wall of the first power/RF housing, and the adapter housing includes a groove that receives the locking tab.

8. The apparatus of claim 1, the adapter assembly further comprises:

a second power/RF housing disposed in the aperture of the adapter housing, the second power/RF housing having an aperture for receiving a power or RF contact; and a second power contact disposed in the aperture of the second power/RF housing, wherein the first signal housing is located between the first and second power/RF housings.

9. The apparatus of claim 1, the adapter assembly further comprises:

a second signal housing disposed in the aperture of the adapter housing, the second signal housing having a first row of apertures and a second row of apertures; and a second set of signal contacts, each contact in said second set of signal contacts being disposed in one of said apertures of the second signal housing, wherein the second signal housing is sandwiched between the first signal housing and the first power/RF housing.

10. The apparatus of claim 1, wherein the header housing includes a rectangular frame having two end walls and two side walls, and the header housing further includes two side walls facing each other, each said side wall extending outwardly from an end wall of the rectangular fame.

11. The apparatus of claim 10, wherein a side wall of the rectangular frame includes a groove, said groove having a depth that decreases as the groove proceeds inwardly from an edge of the side wall, thereby forming a ramp structure.

12. The apparatus of claim 11, wherein both side walls of the rectangular fame include a plurality of grooves, each said groove having a depth that decreases as the groove proceeds inwardly from an edge of the side wall in which the groove is formed.

13. The apparatus of claim 1, wherein the adapter assembly includes an RF contact disposed in the aperture of the first power/RF housing, and the RF contact comprises:

a clamp nut;

a crimp sleeve;

a dielectric sleeve;

a signal contact; and an outer body having a clamp nut receiving end and a lead-in end, wherein the signal contact is housed in the dielectric sleeve, the dielectric sleeve is housed in the crimp sleeve, the crimp sleeve is housed in the outer body, and the clamp nut is engaged with the clamp nut receiving end of the outer body.

* * * * *